US012733673B2

(12) United States Patent
Abi Aoun et al.

(10) Patent No.: US 12,733,673 B2
(45) **Date of Patent: *Sep. 15, 2026**

(54) COMPOSITIONS AND METHODS

(71) Applicant: Nicoventures Trading Limited, London (GB)

(72) Inventors: Walid Abi Aoun, London (GB); John Paul Mua, Winston Salem, NC (US); John Ulrich, Winston Salem, NC (US); John Caraway, Winston Salem, NC (US)

(73) Assignee: NICOVENTURES TRADING LIMITED, London (GB)

( * ) Notice: Subject to any disclaimer, the term of this patent is extended or adjusted under 35 U.S.C. 154(b) by 422 days.

This patent is subject to a terminal disclaimer.

(21) Appl. No.: 18/043,926

(22) PCT Filed: Sep. 3, 2021

(86) PCT No.: PCT/EP2021/074367
§ 371 (c)(1),
(2) Date: Mar. 3, 2023

(87) PCT Pub. No.: WO2022/049248
PCT Pub. Date: Mar. 10, 2022

(65) Prior Publication Data

US 2023/0320408 A1 Oct. 12, 2023

Related U.S. Application Data

(60) Provisional application No. 63/224,551, filed on Jul. 22, 2021, provisional application No. 63/074,088, filed on Sep. 3, 2020.

(51) Int. Cl.
*A24B 15/10* (2006.01)
*A24B 13/00* (2006.01)
(Continued)

(52) U.S. Cl.
CPC ..... *A24B 15/303* (2013.01); *A24B 13/00* (2013.01); *A24B 15/167* (2016.11); *A24B 15/32* (2013.01);
(Continued)

(58) Field of Classification Search
None
See application file for complete search history.

(56) References Cited

U.S. PATENT DOCUMENTS 4,509,537 A 4/1985 Houminer et al.
5,692,526 A 12/1997 Adams et al.
(Continued)

FOREIGN PATENT DOCUMENTS

JP 2010-520764 A 6/2010
JP 2013-507105 A 3/2013
(Continued)

OTHER PUBLICATIONS

International Search Report and Written Opinion received for PCT Patent Application No. PCT/EP2021/074367, mailed on Jan. 7, 2022, 11 Pages.
(Continued)

*Primary Examiner* — Dennis R Cordray
(74) *Attorney, Agent, or Firm* — WOMBLE BOND DICKINSON (US) LLP

(57) ABSTRACT

An amorphous solid for use in aerosol generation, the amorphous solid including about 1 to about 50 wt % constituent, derivative or extract of *cannabis*; about 10 to about 80 wt % aerosol-former material; gelling agent, the gelling agent having cellulose or a derivative thereof, and a non-cellulosic gelling agent; and optionally filler, wherein the amount of gelling agent and optional filler taken together is from about 10 to about 60 wt %; wherein the wt % values are calculated on a dry weight basis.

20 Claims, 6 Drawing Sheets

(51) Int. Cl.

| | |
|---|---|
| ***A24B 15/167*** | (2020.01) |
| ***A24B 15/30*** | (2006.01) |
| ***A24B 15/32*** | (2006.01) |
| ***A24B 15/40*** | (2006.01) |
| ***A24D 1/18*** | (2006.01) |
| ***A24D 1/20*** | (2020.01) |
| ***A24F 40/20*** | (2020.01) |

(52) U.S. Cl.

CPC ..... *A24B 15/403* (2013.01); *A24D 1/18* (2013.01); *A24D 1/20* (2020.01); *A24F 40/20* (2020.01)

(56) References Cited

U.S. PATENT DOCUMENTS

| | | | | |
|---|---|---|---|---|
| 10,321,707 | B2 | 6/2019 | Klipfel et al. | |
| 12,433,322 | B2 | 10/2025 | Liu et al. | |
| 2018/0279666 | A1* | 10/2018 | Aoun | A24B 15/32 |
| 2018/0325164 | A1 | 11/2018 | Tiley et al. | |
| 2019/0116863 | A1 | 4/2019 | Dull | |
| 2020/0253264 | A1 | 8/2020 | Rousseau et al. | |
| 2020/0275688 | A1 | 9/2020 | Rousseau et al. | |
| 2021/0169792 | A1 | 6/2021 | Holton, Jr. et al. | |
| 2021/0177041 | A1 | 6/2021 | Aoun et al. | |
| 2022/0175017 | A1* | 6/2022 | Capelli | A24F 40/46 |
| 2022/0386681 | A1 | 12/2022 | Spieles et al. | |
| 2023/0210786 | A1 | 7/2023 | Saar et al. | |
| 2023/0309606 | A1 | 10/2023 | Abi Aoun et al. | |
| 2023/0354881 | A1 | 11/2023 | Cantieri | |
| 2023/0371578 | A1 | 11/2023 | Balboni | |
| 2024/0306698 | A1 | 9/2024 | De Palo et al. | |

FOREIGN PATENT DOCUMENTS

| | | | |
|---|---|---|---|
| JP | 2017-529848 | A | 10/2017 |
| WO | 2008110932 | A2 | 9/2008 |
| WO | 2011042168 | A1 | 4/2011 |
| WO | 2015/062983 | A2 | 5/2015 |
| WO | 2016/135331 | A1 | 9/2016 |
| WO | 2016/156598 | A1 | 10/2016 |
| WO | 2019048880 | A1 | 3/2019 |
| WO | 2020/025727 | A1 | 2/2020 |
| WO | 2020025701 | A1 | 2/2020 |
| WO | 2020025730 | A1 | 2/2020 |
| WO | 2020025735 | A1 | 2/2020 |
| WO | 2020025737 | A1 | 2/2020 |
| WO | 2020/089077 | A1 | 5/2020 |
| WO | 2020127261 | A1 | 6/2020 |
| WO | 2020/167803 | A1 | 8/2020 |
| WO | 2021069909 | A1 | 4/2021 |
| WO | 2021/085532 | A1 | 5/2021 |
| WO | 2021/089543 | A1 | 5/2021 |
| WO | 2021/105434 | A1 | 6/2021 |
| WO | 2021/105462 | A1 | 6/2021 |
| WO | 2021/105466 | A1 | 6/2021 |
| WO | 2021/116854 | A1 | 6/2021 |
| WO | 2021/116856 | A2 | 6/2021 |
| WO | 2021105472 | A1 | 6/2021 |
| WO | 2021/130695 | A1 | 7/2021 |
| WO | 2021/152087 | A1 | 8/2021 |
| WO | 2021/152334 | A1 | 8/2021 |
| WO | 2021/250516 | A1 | 12/2021 |
| WO | 2022/049243 | A1 | 3/2022 |
| WO | 2022/049248 | A1 | 3/2022 |

OTHER PUBLICATIONS

Hampson et al., "Cannabidiol and (-)Δ9-tetrahydrocannabinol are neuroprotective antioxidants," Proceedings of the National Academy of Sciences, National Academy of Sciences, vol. 95, Jul. 7, 1998, pp. 8268-8273.

* cited by examiner

COMPOSITIONS AND METHODS

PRIORITY CLAIM

The present application is a National Phase entry of PCT Application No. PCT/EP2021/074367, filed Sep. 3, 2021, which claims priority from U.S. Provisional Application No. 63/074,088, filed Sep. 3, 2020 and U.S. Provisional Application No. 63/224,551, filed Jul. 22, 2021, each of which hereby fully incorporated herein by reference.

TECHNICAL FIELD

The present invention relates to aerosol generation for delivery of constituents, derivatives or extracts of *cannabis*. The present invention also relates to compositions for oral delivery of constituents, derivatives or extracts of *cannabis*.

BACKGROUND

Smoking articles such as cigarettes, cigars and the like burn tobacco during use to create tobacco smoke. Alternatives to these types of articles release an inhalable aerosol or vapor by releasing compounds from a substrate material by heating without burning. These may be referred to as non-combustible smoking articles, aerosol generating assemblies or non-combustible aerosol provision systems.

One example of such a product is a heating device which release compounds by heating, but not burning, a solid aerosolisable material. This solid aerosolisable material may, in some cases, contain a tobacco material. The heating volatilizes at least one component of the material, typically forming an inhalable aerosol. These products may be referred to as heat-not-burn devices, tobacco heating devices or tobacco heating products (THP). Various different arrangements for volatilizing at least one component of the solid aerosolisable material are known.

As another example, there are e-cigarette/tobacco heating product hybrid devices, also known as electronic tobacco hybrid devices. These hybrid devices contain a liquid source (which may or may not contain nicotine) which is vaporized by heating to produce an inhalable vapor or aerosol. The device additionally contains a solid aerosolisable material (which may or may not contain a tobacco material) and components of this material are entrained in the inhalable vapor or aerosol to produce the inhaled medium.

SUMMARY OF THE DISCLOSURE

In a first aspect, there is provided an amorphous solid for use in aerosol generation, the amorphous solid comprising:

- about 1 to about 50 wt % constituent, derivative or extract of *cannabis;*
- about 10 to about 80 wt % aerosol-former material;
- gelling agent, the gelling agent comprising cellulose or a derivative thereof, and a non-cellulosic gelling agent; and
- optionally filler, wherein the amount of gelling agent and optional filler taken together is from about 10 to about 60 wt %;

wherein the wt % values are calculated on a dry weight basis.

In a second aspect, there is provided an aerosol-generating material comprising the amorphous solid of the first aspect.

In a third aspect, there is provided a consumable for use in a non-combustible aerosol provision device, the consumable comprising the aerosol-generating material of the second aspect.

In a fourth aspect, there is a provided a non-combustible aerosol provision system comprising the consumable of the third aspect and a non-combustible aerosol provision device.

In a fifth aspect, there is provided a composition for oral delivery of a constituent, derivative or extract of *cannabis*, the composition comprising an amorphous solid, the amorphous solid comprising:

- about 1 to about 50 wt % constituent, derivative or extract of *cannabis;*
- about 10 to about 80 wt % humectant;
- gelling agent, the gelling agent comprising cellulose or a derivative thereof, and a non-cellulosic gelling agent; and
- optionally filler, wherein the amount of gelling agent and optional filler taken together is from about 10 to about 60 wt %;

wherein the wt % values are calculated on a dry weight basis.

In a sixth aspect, there is provided a method of forming the amorphous solid of the first aspect or as defined in the fifth aspect, the method comprising:

(a) providing a slurry comprising the constituent, derivative or extract of *cannabis*, the gelling agent, the gelling agent comprising cellulose or a derivative thereof, and a non-cellulosic gelling agent, the aerosol-former material or the humectant, a solvent and any optional further components of the amorphous solid;
(b) forming a layer of the slurry;
(c) optionally setting the layer of the slurry; and
(d) drying the slurry to form the amorphous solid.

In a seventh aspect, there is provided a slurry comprising:

- about 1 to about 50 wt % constituent, derivative or extract of *cannabis;*
- about 10 to about 80 wt % aerosol-former material or humectant;
- gelling agent, the gelling agent comprising cellulose or a derivative thereof, and a non-cellulosic gelling agent; and
- optionally filler, wherein the amount of gelling agent and optional filler taken together is from about 10 to about 60 wt %;
- wherein the wt % values are calculated on a dry weight basis; and
- a solvent.

The aerosol-former material in the amorphous solid for use in aerosol generation is the same as the humectant in the amorphous solid for oral delivery of constituent(s), derivative(s) or extract(s) of *cannabis*.

To the extent that they are combinable, features described herein in relation to one aspect of the invention are explicitly disclosed in combination with each and every other aspect.

Further aspects of the invention described herein may provide the use of the amorphous solid, the aerosol generating material, the consumable or the non-combustible aerosol provision system, in the generation of an inhalable aerosol.

Further features and advantages of the invention will become apparent from the following description, given by way of example only, and with reference to the accompanying figures.

DETAILED DESCRIPTION

Figure 1:
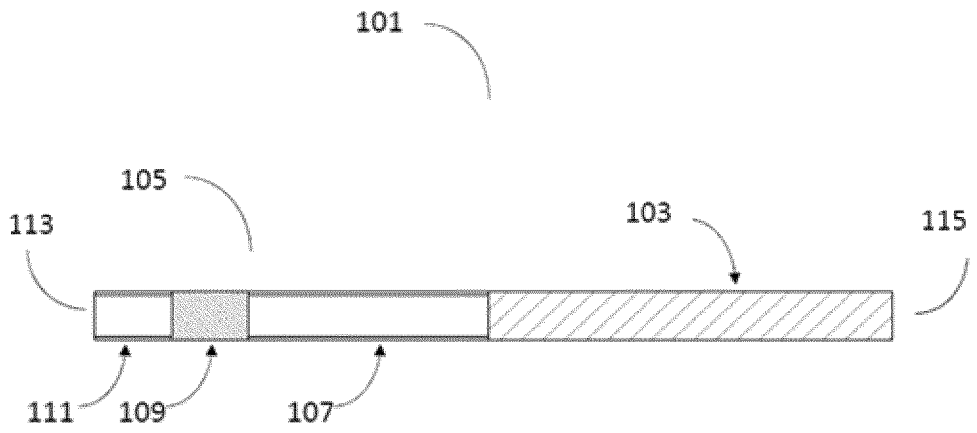
FIG. 1 shows a section view of an example of a consumable.

As noted above, provided is an amorphous solid for use in aerosol generation, the amorphous solid comprising:

about 1 to about 50 wt % constituent, derivative or extract of *cannabis;* about 10 to about 80 wt % aerosol-former material;

gelling agent, the gelling agent comprising cellulose or a derivative thereof, and a non-cellulosic gelling agent; and optionally filler, wherein the amount of gelling agent and optional filler taken together is from about 10 to about 60 wt %;

wherein the wt % values are calculated on a dry weight basis.

Also provided is a composition for oral delivery of a constituent, derivative or extract of *cannabis*, the composition comprising an amorphous solid, the amorphous solid comprising:

about 1 to about 50 wt % constituent, derivative or extract of *cannabis;* about 10 to about 80 wt % humectant;

gelling agent, the gelling agent comprising cellulose or a derivative thereof, and a non-cellulosic gelling agent; and optionally filler, wherein the amount of gelling agent and optional filler taken together is from about 10 to about 60 wt %;

wherein the wt % values are calculated on a dry weight basis.

The amorphous solid may form part of an aerosol-generating material. An aerosol-generating material is a material that is capable of generating aerosol, for example when heated, irradiated or energized in any other way. In some embodiments, the aerosol-generating material comprises an aerosol-generating film that is an amorphous solid.

The amorphous solid may alternatively be referred to as a "monolithic solid" (i.e. non-fibrous). In some embodiments, the amorphous solid may be a dried gel. The amorphous solid is a solid material that may retain some fluid, such as liquid, within it. In some embodiments the retained fluid may be water (such as water absorbed from the surroundings of the amorphous solid) or the retained fluid may be solvent (such as when the amorphous solid is formed from a slurry). In some embodiments, the solvent may be water.

In some embodiments, the aerosol-generating material may for example comprise from about 50 wt %, 60 wt % or 70 wt % of amorphous solid, to about 90 wt %, 95 wt % or 100 wt % of amorphous solid, based on the weight of the aerosol-generating material. These wt % values are calculated on a wet weight basis (WWB), i.e. including any water or other solvent present in the aerosol-generating material or the amorphous solid.

In some embodiments, the aerosol-generating material consists of the amorphous solid.

In some embodiments, the amorphous solid and/or the aerosol generating material consists essentially of, or consists of, gelling agent; solvent; aerosol-former material; constituent, derivative or extract of *cannabis*; and optionally a flavor and/or optionally an additional active substance and/or optionally a filler.

In some cases, the amorphous solid and/or the aerosol generating material consists essentially of, or consists of, gelling agent; solvent; aerosol-former material; and constituent, derivative or extract of *cannabis.*

In some embodiments, the amorphous solid and/or the aerosol generating material consists essentially of, or consists of, gelling agent; solvent; aerosol-former material; cannabinoid; and optionally a flavor and/or optionally an additional active substance and/or optionally a filler.

In some cases, the amorphous solid and/or the aerosol generating material consists essentially of, or consists of, gelling agent; solvent; aerosol-former material; and cannabinoid.

In some embodiments, the amorphous solid and/or the aerosol generating material consists essentially of, or consists of, gelling agent; water; aerosol-former material; constituent, derivative or extract of *cannabis*; and optionally a flavor and/or optionally an additional active substance and/or optionally a filler.

In some cases, the amorphous solid and/or the aerosol generating material consists essentially of, or consists of, gelling agent; water; aerosol-former material; and constituent, derivative or extract of *cannabis.*

In some embodiments, the amorphous solid and/or the aerosol generating material consists essentially of, or consists of, gelling agent; water; aerosol-former material; cannabinoid; and optionally a flavor and/or optionally an additional active substance and/or optionally a filler.

In some cases, the amorphous solid and/or the aerosol generating material consists essentially of, or consists of, gelling agent; water; aerosol-former material; and cannabinoid.

In some embodiments, the amorphous solid is a hydrogel and comprises less than about 20 wt % of water calculated on a wet weight basis. In some cases, the hydrogel may comprise less than about 15 wt %, 12 wt % or 10 wt % of water calculated on a wet weight basis (WWB). In some cases, the hydrogel may comprise at least about 1 wt %, 2 wt % or at least about 5 wt % of water (WWB).

In some embodiments, the amorphous solid may contain less than about 20 wt %, such as less than about 15 wt/0, 12 wt % or 10 wt % of water calculated on a wet weight basis (WWB). For example, the amorphous solid may contain about 1-15 wt % of water, such as 3-12 wt % of water (WWB). In some embodiments the amorphous solid may contain about 1-5 wt % of water (WWB).

Constituent, Derivative or Extract of *Cannabis*

Suitably, the amorphous solid may comprise from about 1 to about 50 wt % of one or more constituents, derivatives or extracts of *cannabis*, for example from about 1.5 wt % or 2 wt % to about 10 wt %, 8 wt %, 7 wt % or 6 wt % of constituent(s), derivative(s) or extract(s) of *cannabis* (all calculated on a dry weight basis). For example, the amorphous solid may comprise about 1-12 wt %, about 1.5-10 wt %, about 1.5-8 wt %, about 2-8 wt %, or about 2-6 wt % constituent(s), derivative(s) or extract(s) of *cannabis*. The amorphous solid may comprise from about 20 wt %, 25 wt %, 30 wt % or 35 wt % to about 40 wt %, 43 wt % or 45 wt % of one or more constituents, derivatives or extracts of *cannabis* (all calculated on a dry weight basis). For example, the amorphous solid may comprise about 15-50 wt %, 25-45 wt %, about 30-43 wt % or about 35-40 wt % constituent(s), derivative(s) or extract(s) of *cannabis*.

As used herein, any compound or mixture of compounds which may be obtained from *cannabis* may be a constituent, derivative or extract thereof, including synthetic versions of such compound(s) or such compound(s) derived from other natural sources.

In some embodiments the constituent(s), derivative(s) or extract(s) of *cannabis* comprises, or is, one or more compounds selected from: cannabinoids, optionally phytocannabinoids that may optionally be THC and/or CBD; terpenes, optionally triterpenes; alkaloids; and flavonoids.

In some embodiments the constituent(s), derivative(s) or extract(s) of *cannabis* comprises one or more compounds selected from: cannabinoids, optionally phytocannabinoids; or terpenes, optionally triterpenes.

In some embodiments the constituent(s), derivative(s) or extract(s) of *cannabis* comprises one or more cannabinoids, optionally phytocannabinoids.

Cannabinoids are a class of natural or synthetic chemical compounds which act on cannabinoid receptors (i.e., CB1 and CB2) in cells that repress neurotransmitter release in the brain. Cannabinoids may be naturally occurring (phytocannabinoids) from plants such as *cannabis*, from animals (endocannabinoids), or artificially manufactured (synthetic cannabinoids). *Cannabis* species express at least 85 different phytocannabinoids, and are divided into subclasses, including cannabigerols, cannabichromenes, cannabidiols, tetrahydrocannabinols, cannabinols and cannabinodiols, and other cannabinoids. Cannabinoids found in *cannabis* include, without limitation: cannabigerol (CBG), cannabichromene (CBC), cannabidiol (CBD), tetrahydrocannabinol (THC), cannabinol (CBN), cannabinodiol (CBDL), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabinerolic acid, cannabidiolic acid (CBDA), cannabinol propyl variant (CBNV), cannabitriol (CBO), tetrahydrocannabmolic acid (THCA), and tetrahydrocannabivarinic acid (THCV A).

In some embodiments, the cannabinoids are phytocannabinoids.

In some embodiments, the terpenes are triterpenes.

In particular embodiments, the constituent, derivative or extract of *cannabis* comprises, or is, tetrahydrocannabinol (THC) and/or cannabidiol (CBD).

In some embodiments, the constituent, derivative or extract of *cannabis* comprises, or is, THC.

In particular embodiments, the constituent, derivative or extract of *cannabis* comprises, or is, CBD.

The inventors have found that constituents, derivatives or extracts of *cannabis* such as CBD may have limited solubility in solutions used in liquid vaping delivery systems, meaning that such systems may not be able to deliver high levels of such materials. Use of amorphous solids may allow for incorporation of higher levels of constituents, derivatives or extracts of *cannabis*, and hence delivery of higher amounts of constituents, derivatives or extracts of *cannabis* to the user.

Aerosol-Former Material

The aerosol-former material may comprise one or more constituents capable of forming an aerosol.

Suitably, the amorphous solid may comprise from about 10 wt % to about 80 wt % of aerosol-former material (calculated on a dry weight basis), for example about 20 wt %, 30 wt % or 40 wt % to about 80 wt %, 75 wt %, 60 wt % or 50 wt %. In some embodiments the amorphous solid may comprise from about 20-80 wt % aerosol-former material. In some embodiments, the amorphous solid may comprise about 50 to 80 wt %, such as about 60 to 80 wt % aerosol-former material. In some embodiments the amorphous solid may comprise from about 30 to 40 wt % aerosol-former material.

In some embodiments, the aerosol-former material may comprise one or more of glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

In some embodiments, the aerosol-former material may comprise one or more of erythritol, propylene glycol, glycerol, and triacetin. In some cases, the aerosol-former material comprises, consists essentially of or consists of glycerol, or a mixture of glycerol and propylene glycol.

In some embodiments, the aerosol-former material comprises a mixture of glycerol and propylene glycol in a weight ratio of glycerol to propylene glycol of about 3:1 to 1:3, about 2:1 to 1:2, about 1.5:1 to 1:1.5, about 55:45 to 45:55, or about 45:55.

The aerosol-former material may act as a plasticizer. If the content of the plasticizer is too high, the amorphous solid may absorb water resulting in a material that does not create an appropriate consumption experience in use. If the plasticizer content is too low, the amorphous solid may be brittle and easily broken. The plasticizer content specified herein provides an amorphous solid flexibility which allows a sheet of the amorphous solid or aerosol-generating material to be wound onto a bobbin, which is useful in manufacture of aerosol generating articles (consumables).

Gelling Agent

Suitably, the amorphous solid comprises from about 10 wt % to about 60 wt % total amount of gelling agent, for example from about 10 wt %, 15 wt %, 20 wt %, or 25 wt % to about 60 wt %, 50 wt %, 45 wt %, 40 wt %, 35 wt % or 30 wt % total amount of gelling agent (all calculated on a dry weight basis). For example, the amorphous solid may comprise about 10-50 wt %, 15-45 wt/0, 20-45 wt/0, 15-40 wt/0, or 20-30 wt % total amount of the gelling agent.

In some embodiments, the amorphous solid may comprise a total of about 15-35 wt % of the gelling agent.

The gelling agent comprises cellulose or a derivative thereof, and a non-cellulosic gelling agent.

The term "cellulosic" may be used herein in place of the term "cellulose or a derivative thereof". Examples of cellulosic gelling agents include, but are not limited to, hydroxymethyl cellulose, hydroxyethyl cellulose, hydroxypropyl cellulose, carboxymethyl cellulose (CMC), hydroxypropyl methylcellulose (HPMC), methyl cellulose, ethyl cellulose, cellulose acetate (CA), cellulose acetate butyrate (CAB), and cellulose acetate propionate (CAP). In some embodiments, the cellulosic gelling agent is selected from hydroxyethyl cellulose, hydroxypropyl cellulose, and/or carboxymethyl cellulose. In some embodiments, the cellulosic gelling agent comprises carboxymethyl cellulose. In some embodiments, the cellulosic gelling agent is carboxymethyl cellulose.

The non-cellulosic gelling agent may be selected from alginate, pectin, starch or a derivative thereof, pullulan, carrageenan, agar and agarose; gelatin; gums, such as xanthan gum, guar gum and acacia gum; silica or silicone compounds, such as PDMS and sodium silicate; clays, such as kaolin; and polyvinyl alcohol. In some embodiments, the non-cellulosic gelling agent is selected from alginate, pectin, starch or a derivative thereof, or guar gum. In some embodiments, the non-cellulosic gelling agent comprises alginate. In some embodiments, the non-cellulosic gelling agent is alginate.

In some embodiments, the gelling agent comprises, consists essentially of or consists of carboxymethyl cellulose and alginate.

In some embodiments, the weight ratio of cellulosic gelling agent to non-cellulosic gelling agent is from 1:4 to 4:1, 2:3 to 7:3, 2:3 to 3:2 or 1:1 to 3:2. In some embodiments, the weight ratio of cellulosic gelling agent to non-cellulosic gelling agent is >1:1. That is, in some embodiments, the cellulosic gelling agent is present in an amount greater than the amount of non-cellulosic gelling agent. In some embodiments, the weight ratio of cellulosic gelling agent to non-cellulosic gelling agent is about 1:1.

In some embodiments, the amorphous solid comprises a crosslinking agent. In some cases, the crosslinking agent comprises calcium ions. In some cases, the amorphous solid may comprise carboxymethyl cellulose and a calcium-crosslinked alginate. The crosslinking agent may also be described as a setting agent. In some embodiments the gelling agent is not crosslinked. The absence of crosslinks in the gelling agent facilitates quicker delivery of the constituent, derivative or extract of *cannabis* (and any optional additional active substances and/or flavors) from the amorphous solid.

Without wishing to be bound by theory, it is believed that by including a gelling agent comprising (i) cellulose or a derivative thereof, and (ii) a non-cellulosic gelling agent in the amorphous solid, the release temperature of the constituent, derivative or extract of *cannabis* can be controlled. For example, the temperature at which the constituent, derivative or extract of *cannabis* is released may be increased by increasing the amount of CMC relative to alginate. Increasing the amount of cellulosic gelling agent relative to non-cellulosic gelling agent (such as alginate) may also be preferable for reasons of reduced cost and/or ease of manufacture. Thus, the combination of cellulosic and non-cellulosic gelling agents (e.g. CMC and alginate) may allow for reduced costs and/or easier manufacture than formulations containing alginate alone. The combination of cellulosic and non-cellulosic gelling agents (e.g. CMC and alginate) may also allow for the active release temperature to be adjusted.

Filler

The aerosol-generating material may further comprise a filler. Use of a filler may help to reduce tackiness of the amorphous solid, for example if high levels of aerosol-former material are present.

Suitably, the amorphous solid comprises from about 10 wt % to about 60 wt % gelling agent and any optional filler.

In some embodiments, the amorphous solid may comprise less than about 50 wt % of a filler, such as from about 1 wt % to 50 wt %, or 5 wt % to 40 wt %, or 5 wt % to 30 wt %, or 10 wt % to 20 wt %.

In other embodiments, the amorphous solid comprises less than 20 wt %, suitably less than 10 wt % or less than 5 wt % of a filler. In some cases, the amorphous solid comprises less than 1 wt % of a filler, and in some cases, comprises no filler.

The filler, if present, may comprise one or more inorganic filler materials, such as calcium carbonate, perlite, vermiculite, diatomaceous earth, colloidal silica, magnesium oxide, magnesium sulphate, magnesium carbonate, and suitable inorganic sorbents, such as molecular sieves. The filler may comprise one or more organic filler materials such as wood pulp; tobacco pulp; hemp fiber; starch and starch derivatives, such as maltodextrin; chitosan; and cellulose and cellulose derivatives, such as ground cellulose, microcrystalline cellulose and nanocrystalline cellulose. In particular cases, the amorphous solid comprises no calcium carbonate such as chalk.

As would be well understood by the skilled person, microcrystalline cellulose may be formed by depolymerizing cellulose by a chemical process (e.g. using an acid or enzyme). One example method for forming microcrystalline cellulose involves acid hydrolysis of cellulose, using an acid such as HCl. The cellulose produced after this treatment is crystalline (i.e. no amorphous regions remain). Suitable methods and conditions for forming microcrystalline cellulose are well-known in the art.

In particular embodiments which include filler, the filler is fibrous. For example, the filler may be a fibrous organic filler material such as wood pulp, tobacco pulp, hemp fiber, cellulose or cellulose derivatives. In some embodiments, the fibrous organic filler material may be wood pulp, hemp fiber, cellulose or cellulose derivatives. In some embodiments, the fibrous filler is wood pulp. Without wishing to be bound by theory, it is believed that including fibrous filler in an amorphous solid may increase the tensile strength of the material. This may be particularly advantageous in examples wherein the amorphous solid is provided as a sheet, such as when an amorphous solid sheet circumscribes a rod of aerosolisable material.

In some embodiments the gelling agent comprises CMC and is used together with wood pulp as a filler.

In some embodiments, the aerosol-generating material may further comprise one or more other functional material (s).

In some embodiments, the amorphous solid may further comprise one or more additional active substances and/or flavors, and optionally one or more other functional material.

Additional Active Substances

In particular embodiments, constituent(s), derivative(s) or extract(s) of *cannabis* is or are the only active(s) present in the amorphous solid. In particular embodiments, constituent (s), derivative(s) or extract(s) of *cannabis* is or are the only active(s) present in the aerosol-generating material. However, the amorphous solid and/or the aerosol-generating material may further comprise additional active ingredients.

In some cases, the amorphous solid may comprise from about 1 wt %, 5 wt %, 10 wt %, 15 wt %, 20 wt % or 25 wt % to about 65 wt %, 60 wt %, 50 wt %, 45 wt %, 40 wt %, 35 wt %, or 30 wt % (calculated on a dry weight basis) of another active substance in addition to constituent(s), derivative(s) or extract(s) of *cannabis*.

The additional active substance as used herein may be a physiologically active material, which is a material intended to achieve or enhance a physiological response. The additional active substance may for example be selected from nutraceuticals, nootropics and psychoactives. The additional active substance may be naturally occurring or synthetically obtained. The additional active substance may comprise for example nicotine, caffeine, taurine, theine, vitamins such as B6 or B12 or C, melatonin, or constituents, derivatives, or combinations thereof. The additional active substance may comprise one or more constituents, derivatives or extracts of tobacco or another botanical.

In one embodiment the active substance is a legally permissible recreational drug.

In some embodiments, the additional active substance comprises nicotine.

In some embodiments, the additional active substance comprises caffeine, melatonin or vitamin B12.

As noted herein, the additional active substance may comprise or be derived from one or more botanicals or constituents, derivatives or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, *eucalyptus*, star anise, hemp, cocoa, coffee, fennel, lemongrass, peppermint, spearmint, rooibos, chamomile, flax, ginger, *Ginkgo biloba*, hazel, hibiscus, laurel, licorice (liquorice), matcha, mate, orange skin, *papaya*, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, *curcuma*, turmeric, sandalwood, cilantro, bergamot, orange blossom, myrtle, cassis, valerian, pimento, mace, damien, marjoram, olive, lemon balm, lemon basil, chive, *carvi, verbena*, tarragon, geranium, mulberry, *ginseng*, theanine, theacrine, maca, ashwagandha, damiana, guarana, chlorophyll, baobab or any combination thereof. The mint may be chosen from the following mint varieties: *Mentha arventis, Mentha* c.v., *Mentha niliaca, Mentha piperita, Mentha piperita citrata* c.v., *Mentha piperita* c.v., *Mentha spicata crispa, Mentha cardifolia, Mentha longifolia, Mentha suaveolens variegata, Mentha pulegium, Mentha spicata* c.v. and *Mentha suaveolens.*

In some embodiments, the additional active substance comprises or is derived from one or more botanicals or constituents, derivatives or extracts thereof and the botanical is tobacco.

In some embodiments, the additional active substance comprises or derived from one or more botanicals or constituents, derivatives or extracts thereof and the botanical is selected from *eucalyptus*, star anise, cocoa and hemp. In some embodiments the additional active substance comprises (or is) a botanical selected from *eucalyptus*, star anise, cocoa and hemp.

In some embodiments, the additional active substance comprises or derived from one or more botanicals or constituents, derivatives or extracts thereof and the botanical is selected from rooibos and fennel. In some embodiments, the additional active substance comprises (or is) a botanical selected from rooibos and fennel.

For example, in some cases, the amorphous solid additionally comprises a tobacco material and/or nicotine. In some cases, the amorphous solid may comprise 5-60 wt % (calculated on a dry weight basis) of a tobacco material and/or nicotine.

In some cases, the amorphous solid may comprise from about 1 wt %, 5 wt %, 10 wt %, 15 wt %, 20 wt % or 25 wt % to about 65 wt %, 60 wt %, 50 wt %, 45 wt %, 40 wt %, 35 wt %, or 30 wt % (calculated on a dry weight basis) of a tobacco material. For example, the amorphous solid may comprise up to about 50 wt % of a tobacco material. For example, the amorphous solid may comprise about 10-50 wt %, 15-40 wt % or 20-35 wt % of a tobacco material. In some cases, the amorphous solid may comprise from about 1 wt %, 2 wt %, 3 wt % or 4 wt % to about 20 wt %, 18 wt %, 15 wt % or 12 wt % (calculated on a dry weight basis) of nicotine. For example, the amorphous solid may comprise about 1-20 wt %, 2-18 wt % or 3-12 wt % of nicotine.

In some cases, the amorphous solid comprises an additional active substance such as tobacco extract. In some cases, the amorphous solid may comprise 5-60 wt % (calculated on a dry weight basis) of tobacco extract. In some cases, the amorphous solid may comprise from about 5 wt %, 10 wt %, 15 wt %, 20 wt % or 25 wt % to about 60 wt %, 50 wt %, 45 wt %, 40 wt %, 35 wt %, or 30 wt % (calculated on a dry weight basis) tobacco extract. For example, the amorphous solid may comprise about 10-50 wt %, 15-40 wt % or 20-35 wt % of tobacco extract. The tobacco extract may contain nicotine at a concentration such that the amorphous solid comprises about 1 wt % 1.5 wt %, 2 wt % or 2.5 wt % to about 6 wt %, 5 wt %, 4.5 wt % or 4 wt % (calculated on a dry weight basis) of nicotine. In some cases, there may be no nicotine in the amorphous solid other than that which results from any tobacco extract.

In some embodiments the amorphous solid in the aerosol-generating material comprises no tobacco material but does comprise nicotine. In some such cases, the amorphous solid may comprise from about 1 wt %, 2 wt %, 3 wt % or 4 wt % to about 20 wt %, 18 wt %, 15 wt % or 12 wt % (calculated on a dry weight basis) of nicotine. For example, the amorphous solid may comprise about 1-20 wt %, 2-18 wt % or 3-12 wt % of nicotine.

In some embodiments, the amorphous solid and the aerosol-generating material are substantially free from any tobacco material (including tobacco extract) or nicotine. In some embodiments, the amorphous solid and the aerosol-generating material do not contain any tobacco material (including tobacco extract) or nicotine.

In some embodiments, the amorphous solid does not comprise tobacco fibers. In particular embodiments, the amorphous solid does not comprise fibrous material.

In some embodiments, the aerosol-generating material does not comprise tobacco fibers. In particular embodiments, the aerosol-generating material does not comprise fibrous material.

Flavors

The amorphous solid and/or the aerosol-generating material may optionally comprise a flavor. For example, the amorphous solid may comprise up to about 65 wt %, 55 wt %, 50 wt % or 45 wt % of a flavor. In some cases, the amorphous solid may comprise at least about 0.1 wt %, 1 wt %, 10 wt %, 20 wt %, 30 wt %, 35 wt % or 40 wt % of a flavor (all calculated on a dry weight basis). For example, the amorphous solid may comprise 1-65 wt %, 10-65 wt %, 20-50 wt %, or 30-40 wt % a flavor.

As used herein, the terms "flavor" and "flavorant" refer to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof (e.g., tobacco, *cannabis*, licorice (liquorice), *hydrangea*, eugenol, Japanese white bark *magnolia* leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, *papaya*, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, *betel*, shisha, pine, honey essence, rose oil, vanilla, lemon oil, orange oil, orange blossom, cherry blossom, *cassia*, caraway, cognac, jasmine, ylang-ylang, sage, fennel, wasabi, piment, ginger, coriander, coffee, hemp, a mint oil from any species of the genus *Mentha, eucalyptus*, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, *curcuma*, cilantro, myrtle, cassis, valerian, pimento, mace, damien, marjoram, olive, lemon balm, lemon basil, chive, *carvi, verbena*, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavor comprises menthol, spearmint and/or peppermint.

In some embodiments, the flavor comprises flavor components of cucumber, blueberry, citrus fruits and/or redberry.

In some embodiments, the flavor comprises eugenol.

In some embodiments, the flavor comprises flavor components extracted from tobacco.

In some embodiments, the flavor comprises flavor components extracted from *cannabis*.

In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol or WS-3 (N-ethyl-2-isopropyl-5-methylcyclohexanecarboxamide).

In some cases, the amorphous solid may additionally comprise an emulsifying agent, which emulsifies molten flavor during manufacture. For example, the amorphous solid may comprise from about 5 wt % to about 15 wt % of an emulsifying agent (calculated on a dry weight basis), suitably about 10%. The emulsifying agent may comprise acacia gum.

In some cases, the total content of additional active substance and/or flavor may be at least about 0.1 wt %, 1 wt %, 5 wt %, 10 wt %, 20 wt %, 25 wt % or 30 wt %. In some cases, the total content of additional active substance and/or flavor may be less than about 60 wt %, 50 wt % or 40 wt % (all calculated on a dry weight basis).

In some cases, the total content of tobacco material, nicotine and/or flavor may be at least about 0.1 wt %, 1 wt %, 5 wt %, 10 wt %, 20 wt %, 25 wt % or 30 wt %. In some cases, the total content of tobacco material, nicotine and/or flavor may be less than about 60 wt %, 50 wt % or 40 wt % (all calculated on a dry weight basis).

Other Functional Materials

The one or more other functional materials may comprise one or more of pH regulators, coloring agents, preservatives, stabilizers, and/or antioxidants.

In some embodiments, the amorphous solid is formed as a sheet. In some cases, the amorphous solid sheet may be incorporated into the non-combustible aerosol provision system or consumable in sheet form. The amorphous solid sheet may be incorporated as a planar sheet, as a gathered or bunched sheet, as a crimped sheet, or as a rolled sheet (i.e. in the form of a tube). In some such cases, the amorphous solid of these embodiments may be included in the system/consumable as a sheet, such as a sheet circumscribing a rod of aerosolisable material (e.g. tobacco). For example, the amorphous solid sheet may be formed on a wrapping paper which circumscribes an aerosolisable material such as tobacco. In other cases, the sheet may be shredded and then incorporated into the assembly, suitably mixed into an aerosolisable material such as cut rag tobacco.

In some cases, the amorphous solid may be in the form of a sheet or layer having a thickness of about 0.015 mm to about 1.0 mm. Suitably, the thickness may be in the range of about 0.05 mm, 0.1 mm or 0.15 mm to about 0.5 mm or 0.3 mm, for example 0.1-3 mm or 0.15-3 mm. A material having a thickness of 0.2 mm may be particularly suitable. The amorphous solid may comprise more than one layer, and the thickness described herein refers to the aggregate thickness of those layers.

If the amorphous solid is too thick, then heating efficiency may be compromised. This adversely affects the power consumption in use. Conversely, if the amorphous solid is too thin, it may be difficult to manufacture and handle; a very thin material is harder to cast and may be fragile, compromising aerosol formation in use.

The thickness stipulated herein is a mean thickness for the material. In some cases, the amorphous solid thickness may vary by no more than 25%, 20%, 15%, 10%, 5% or 1%.

In some examples, the amorphous solid in sheet form may have a tensile strength of from around 200 N/m to around 2000 N/m. In some examples, the amorphous solid in sheet form may have a tensile strength of from around 200 N/m to around 900 N/m. In some examples, such as where the amorphous solid does not comprise a filler, the amorphous solid in sheet form may have a tensile strength of from around 200 N/m to around 400 N/m, or around 200 N/m to around 300 N/m, or about 250 N/m. Such tensile strengths may be particularly suitable for embodiments wherein the amorphous solid and/or the aerosol-generating material is formed as a sheet and then shredded and incorporated into a consumable. In some examples, such as where the amorphous solid comprises a filler, the amorphous solid may have a tensile strength of from around 600 N/m to around 900 N/m, or from around 700 N/m to around 900 N/m, or around 800 N/m. Such tensile strengths may be particularly suitable for embodiments wherein the amorphous solid and/or the aerosol-generating material is included in a consumable/non-combustible aerosol provision system as a rolled sheet, suitably in the form of a tube.

The aerosol-generating material comprising the amorphous solid may have any suitable area density, such as from 30 $g/m^2$ to 120 $g/m^2$. In some cases, the aerosol-generating material may have a mass per unit area of 80-120 $g/m^2$, or from about 70 to 110 $g/m^2$, or particularly from about 90 to 110 $g/m^2$, or suitably about 100 $g/m^2$ (so that it has a similar density to cut rag tobacco and a mixture of these substances will not readily separate). Such area densities may be particularly suitable where the aerosol-generating material is included in assembly consumable/system in sheet form, or as a shredded sheet (described further hereinbelow). In some cases, the aerosol-generating material may have a mass per unit area of about 30 to 70 $g/m^2$, 40 to 60 $g/m^2$, or 25-60 $g/m^2$ and may be used to wrap an aerosolisable material such as tobacco.

The amorphous solid for use in aerosol generation may be present on or in a support, to form a substrate. The support may, for example, be or comprise paper, card, paperboard, cardboard, reconstituted material, a plastics material, a ceramic material, a composite material, glass, a metal, or a metal alloy. In some embodiments, the support comprises a susceptor. In some embodiments, the susceptor is embedded within the material. In some alternative embodiments, the susceptor is on one or either side of the material.

The aerosol-generating material may comprise a carrier on which the amorphous solid is provided. The carrier functions as a support on which the amorphous solid layer forms, easing manufacture. The carrier may provide tensile strength to the amorphous solid layer, easing handling.

In some cases, the carrier may be formed from materials selected from metal foil, paper, carbon paper, greaseproof paper, ceramic, carbon allotropes such as graphite and graphene, plastic, cardboard, wood or combinations thereof. In some cases, the carrier may comprise or consist of a tobacco material, such as a sheet of reconstituted tobacco. In some cases, the carrier may be formed from materials selected from metal foil, paper, cardboard, wood or combinations thereof. In some cases, the carrier itself be a laminate structure comprising layers of materials selected from the preceding lists. In some cases, the carrier may also function as a flavor carrier. For example, the carrier may be impregnated with a flavor or with tobacco extract.

In some cases, the carrier may be magnetic. This functionality may be used to fasten the carrier to the non-combustible aerosol provision device in use, or may be used to generate particular amorphous solid shapes. In some cases, the aerosol-generating material may comprise one or more magnets which can be used to fasten the material to an induction heater in use.

In some cases, the carrier may be substantially or wholly impermeable to gas and/or aerosol. This prevents aerosol or gas passage through the carrier layer, thereby controlling the flow and ensuring it is delivered to the user. This can also be used to prevent condensation or other deposition of the gas/aerosol in use on, for example, the surface of a heater provided in an aerosol generating assembly. Thus, consumption efficiency and hygiene can be improved in some cases.

In some cases, the surface of the carrier that abuts the amorphous solid may be porous. For example, in one case, the carrier comprises paper. A porous carrier such as paper has been found to be particularly suitable; the porous (e.g. paper) layer abuts the amorphous solid layer and forms a strong bond. The amorphous solid may be formed by drying a gel and, without being limited by theory, it is thought that the slurry from which the gel is formed partially impregnates the porous carrier (e.g. paper) so that when the gel sets, the carrier is partially bound into the gel. This provides a strong binding between the gel and the carrier (and between the dried gel and the carrier).

In some embodiments, the amorphous solid may be laminated to a carrier, such as a paper sheet.

In some embodiments, when the amorphous solid is formed from a slurry as described herein, the layer of slurry may be formed on a carrier, such as a paper sheet.

Additionally, surface roughness may contribute to the strength of bond between the amorphous material and the carrier. The paper roughness (for the surface abutting the carrier) may suitably be in the range of 50-1000 Bekk seconds, suitably 50-150 Bekk seconds, suitably 100 Bekk seconds (measured over an air pressure interval of 50.66-48.00 kPa). (A Bekk smoothness tester is an instrument used to determine the smoothness of a paper surface, in which air at a specified pressure is leaked between a smooth glass surface and a paper sample, and the time (in seconds) for a fixed volume of air to seep between these surfaces is the "Bekk smoothness".)

Conversely, the surface of the carrier facing away from the amorphous solid may be arranged in contact with the heater, and a smoother surface may provide more efficient heat transfer. Thus, in some cases, the carrier is disposed so as to have a rougher side abutting the amorphous material and a smoother side facing away from the amorphous material.

In one particular case, the carrier may be a paper-backed foil; the paper layer abuts the amorphous solid layer and the properties discussed in the previous paragraphs are afforded by this abutment. The foil backing is substantially impermeable, providing control of the aerosol flow path. A metal foil backing may also serve to conduct heat to the amorphous solid.

In another case, the foil layer of the paper-backed foil abuts the amorphous solid. The foil is substantially impermeable, thereby preventing water provided in the amorphous solid from being absorbed into the paper which could weaken its structural integrity.

In some cases, the carrier is formed from or comprises metal foil, such as aluminium foil. A metallic carrier may allow for better conduction of thermal energy to the amorphous solid. Additionally, or alternatively, a metal foil may function as a susceptor in an induction heating system. In particular embodiments, the carrier comprises a metal foil layer and a support layer, such as cardboard. In these embodiments, the metal foil layer may have a thickness of less than 20 μm, such as from about 1 μm to about 10 μm, suitably about 5 μm.

In some cases, the carrier may have a thickness of between about 0.010 mm and about 2.0 mm, suitably from about 0.015 mm, 0.02 mm, 0.05 mm or 0.1 mm to about 1.5 mm, 1.0 mm, or 0.5 mm.

Consumable

In another aspect of the disclosure, there is provided a consumable for use in a non-combustible aerosol provision device, the consumable comprising an aerosol-generating material, wherein the aerosol-generating material comprises an amorphous solid, the amorphous solid comprising:

- about 1 to about 50 wt % constituent, derivative or extract of *cannabis;*
- about 10 to about 80 wt % aerosol-former material;
- gelling agent, the gelling agent comprising cellulose or a derivative thereof, and a non-cellulosic gelling agent; and
- optionally filler, wherein the amount of gelling agent and optional filler taken together is from about 10 to about 60 wt %;

wherein the wt % values are calculated on a dry weight basis.

In some embodiments, the disclosure relates to consumables comprising aerosol-generating material and configured to be used with non-combustible aerosol provision devices. These consumables are sometimes referred to as articles throughout the disclosure.

The consumable may be used with any suitable non-combustible aerosol provision device.

A consumable is an article comprising or consisting of aerosol-generating material, part or all of which is intended to be consumed during use by a user. A consumable may comprise one or more other components, such as an aerosol-generating material storage area, an aerosol-generating material transfer component, an aerosol generation area, a housing, a wrapper, a mouthpiece, a filter and/or an aerosol-modifying agent. A consumable may also comprise an aerosol generator, such as a heater, that emits heat to cause the aerosol-generating material to generate aerosol in use. The heater may, for example, comprise combustible material, a material heatable by electrical conduction, or a susceptor.

A susceptor is a material that is heatable by penetration with a varying magnetic field, such as an alternating magnetic field. The susceptor may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The susceptor may be both electrically-conductive and magnetic, so that the susceptor is heatable by both heating mechanisms. The device that is configured to generate the varying magnetic field is referred to as a magnetic field generator, herein.

An aerosol-modifying agent is a substance, typically located downstream of the aerosol generation area, that is configured to modify the aerosol generated, for example by changing the taste, flavor, acidity or another characteristic of the aerosol. The aerosol-modifying agent may be provided in an aerosol-modifying agent release component that is operable to selectively release the aerosol-modifying agent.

The aerosol-modifying agent may, for example, be an additive or a sorbent. The aerosol-modifying agent may, for example, comprise one or more of a flavorant, a colorant, water, and a carbon adsorbent. The aerosol-modifying agent may, for example, be a solid, a liquid, or a gel. The aerosol-modifying agent may be in powder, thread or granule form. The aerosol-modifying agent may be free from filtration material.

An aerosol generator is an apparatus configured to cause aerosol to be generated from the aerosol-generating material. In some embodiments, the aerosol generator is a heater configured to subject the aerosol-generating material to heat energy, so as to release one or more volatiles from the aerosol-generating material to form an aerosol. In some embodiments, the aerosol generator is configured to cause an aerosol to be generated from the aerosol-generating material without heating. For example, the aerosol generator may be configured to subject the aerosol-generating material to one or more of vibration, increased pressure, or electrostatic energy.

The aerosol-generating material may comprise or be in the form of an aerosol-generating film. The aerosol-generating film may be substantially free from botanical material. In particular, in some embodiments, the aerosol-generating film is substantially tobacco free.

The aerosol-generating film may have a thickness of about 0.015 mm to about 1 mm. For example, the thickness may be in the range of about 0.05 mm, 0.1 mm or 0.15 mm to about 0.5 mm or 0.3 mm.

The aerosol-generating film may be continuous. For example, the film may comprise or be a continuous sheet of material. The sheet may be in the form of a wrapper, it may be gathered to form a gathered sheet or it may be shredded to form a shredded sheet. The shredded sheet may comprise one or more strands or strips of amorphous solid.

Figure 8:
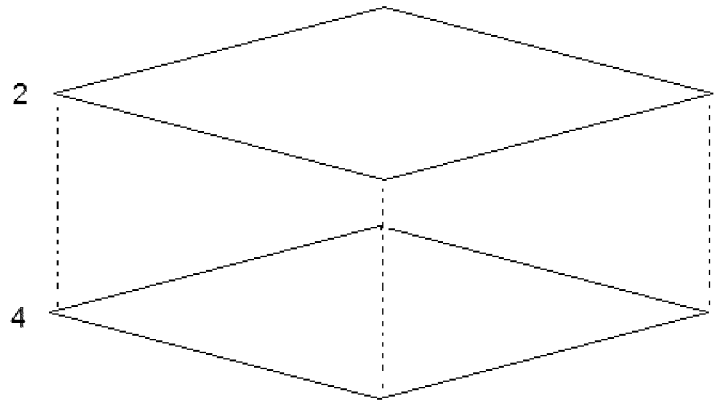
FIG. 8 shows an exploded diagram of an example consumable.

In one case, there is provided a consumable for use in a non-combustible aerosol-provision system comprising a planar support with complete coverage of the amorphous solid (e.g. a continuous aerosol-generating film). FIG. 8 provides a schematic illustration of such a consumable, which includes a support layer 4 and an amorphous solid layer 2.

The aerosol-generating film may be discontinuous, For example, the aerosol-generating film may comprise one or more discrete portions or regions of amorphous solid, such as dots, stripes or lines, which may be supported on a support. In such embodiments, the support may be planar or non-planar.

In some cases, the discrete portions of amorphous solid are substantially round, cylindrical or hemispherical. In some cases, there is a grid-shaped distribution of the substantially round, cylindrical or hemispherical amorphous solid.

In some cases, there is provided a consumable for use in a non-combustible aerosol-provision system comprising a planar support with a discontinuous aerosol-generating film (which comprises a plurality of discrete portions of amorphous solid) deposited on it.

Figure 9:
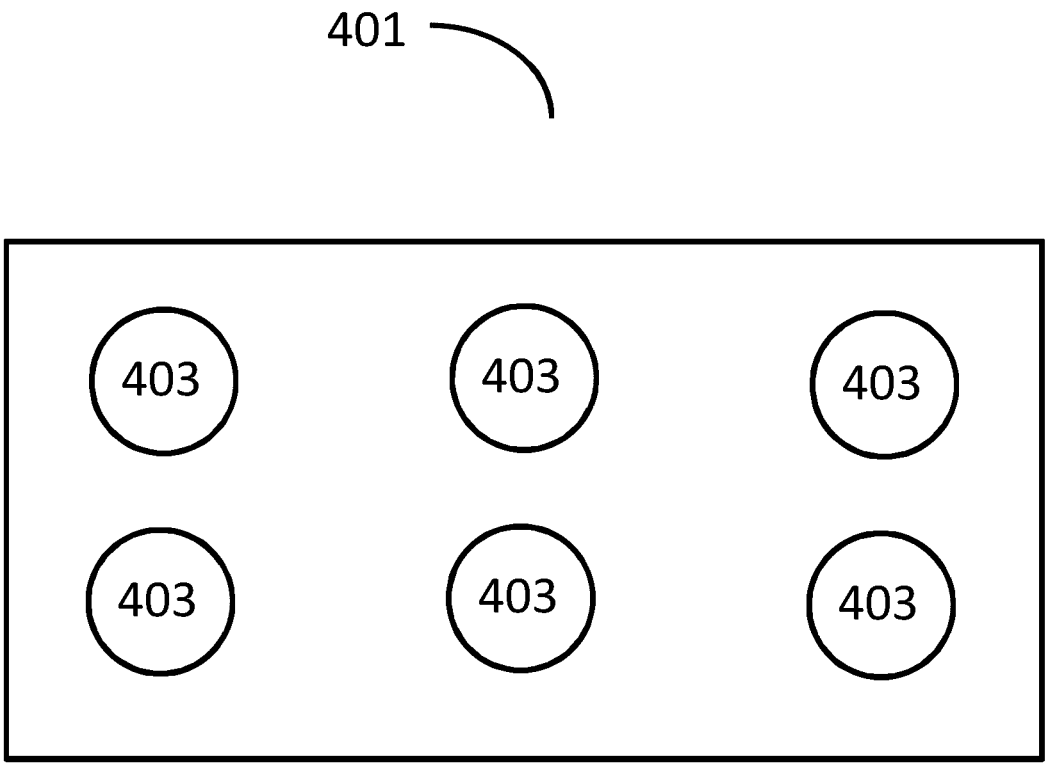
FIG. 9 shows an example of a consumable comprising a plurality of discrete portions of aerosol-generating material.

FIG. 9 provides an example of a consumable (401) wherein a discontinuous aerosol-generating film (which comprises discrete portions of amorphous solid (403)) are provided on the consumable.

Non-Combustible Aerosol Provision System

In another aspect of the disclosure, there is provided a non-combustible aerosol provision system comprising the consumable described herein and a non-combustible aerosol provision device.

According to the present disclosure, a "non-combustible" aerosol provision system is one where a constituent aerosol-generating material of the aerosol provision system (or component thereof) is not combusted or burned in order to facilitate delivery of at least one substance to a user.

In some embodiments, the delivery system is a non-combustible aerosol provision system, such as a powered non-combustible aerosol provision system.

In some embodiments, the non-combustible aerosol provision system is an aerosol-generating material heating system, also known as a heat-not-burn system. An example of such a system is a tobacco heating system.

In some embodiments, the non-combustible aerosol provision device is a heat-not-burn device.

In some embodiments, the non-combustible aerosol provision system is a hybrid system to generate aerosol using a combination of aerosol-generating materials, one or a plurality of which may be heated. In some embodiments, the hybrid system comprises the aerosol-generating material described herein comprising or consisting of the amorphous solid and an additional liquid or gel aerosol-generating material.

In some embodiments, the non-combustible aerosol provision device is an electronic tobacco hybrid device.

Typically, the non-combustible aerosol provision system may comprise a non-combustible aerosol provision device and a consumable for use with the non-combustible aerosol provision device.

In some embodiments, the non-combustible aerosol provision system, such as a non-combustible aerosol provision device thereof, may comprise a power source and a controller. The power source may, for example, be an electric power source or an exothermic power source. In some embodiments, the exothermic power source comprises a carbon substrate which may be energized so as to distribute power in the form of heat to an aerosol-generating material or to a heat transfer material in proximity to the exothermic power source.

In some embodiments, the non-combustible aerosol provision system, such as a non-combustible aerosol provision device thereof, may comprise an area for receiving the consumable, an aerosol generator, an aerosol generation area, a housing, a mouthpiece, a filter and/or an aerosol-modifying agent.

The non-combustible aerosol provision system or device may comprise a heater configured to heat but not burn the aerosol generating substrate. The heater may be, in some cases, a thin film, electrically resistive heater. In other cases, the heater may comprise an induction heater or the like. In yet further cases, the heater may be a combustible heat source or a chemical heat source which undergoes an exothermic reaction to produce heat in use.

In some cases, the heater may heat but not burn the aerosolisable material(s) to between 120° C. and 350° C. in use. In some cases, the heater may heat but not burn the aerosolisable material(s) to between 140° C. and 250° C. in use. In some cases in use, substantially all of the amorphous solid is less than about 4 mm, 3 mm, 2 mm or 1 mm from the heater. In some cases, the solid is disposed between about 0.017 mm and 2.0 mm from the heater, suitably between about 0.1 mm and 1.0 mm. These minimum distances may, in some cases, reflect the thickness of a carrier that supports the amorphous solid. In some cases, a surface of the amorphous solid may directly abut the heater.

In some cases, the heater may be embedded in the aerosol-generating material. In some such cases, the heater may be an electrically resistive heater (with exposed contacts for connection to an electrical circuit). In other such cases, the heater may be a susceptor embedded in the aerosol-generating material, which is heated by induction.

The non-combustible aerosol provision system may additionally comprise a cooling element and/or a filter. The cooling element, if present, may act or function to cool gaseous or aerosol components. In some cases, it may act to cool gaseous components such that they condense to form an aerosol. It may also act to space the very hot parts of the apparatus from the user. The filter, if present, may comprise any suitable filter known in the art such as a cellulose acetate plug.

In some cases, the non-combustible aerosol provision system may be a heat-not-burn system. That is, it may contain a solid material (and no liquid aerosolisable material). A heat-not-burn device is disclosed in WO 2015/062983 A2, which is incorporated by reference in its entirety.

In some cases, the non-combustible aerosol provision system may comprise an electronic tobacco hybrid device. That is, it may contain a solid aerosolisable material and a liquid aerosolisable material. The separate aerosolisable materials may be heated by separate heaters, the same heater or, in one case, a downstream aerosolisable material may be heated by a hot aerosol which is generated from the upstream aerosolisable material. An electronic tobacco hybrid device is disclosed in WO 2016/135331 A1, which is incorporated by reference in its entirety.

The consumable may alternatively be referred to herein as a cartridge. The consumable may be adapted for use in a THP, an electronic tobacco hybrid device or another aerosol generating device. In some cases, the consumable may additionally comprise a filter and/or cooling element, as described previously. In some cases, the consumable may be circumscribed by a wrapping material such as paper.

The consumable may additionally comprise ventilation apertures. These may be provided in the sidewall of the article. In some cases, the ventilation apertures may be provided in the filter and/or cooling element. These apertures may allow cool air to be drawn into the article during use, which can mix with the heated volatilized components thereby cooling the aerosol.

The ventilation enhances the generation of visible heated volatilized components from the article when it is heated in use. The heated volatilized components are made visible by the process of cooling the heated volatilized components such that supersaturation of the heated volatilized components occurs. The heated volatilized components then undergo droplet formation, otherwise known as nucleation, and eventually the size of the aerosol particles of the heated volatilized components increases by further condensation of the heated volatilized components and by coagulation of newly formed droplets from the heated volatilized components.

In some cases, the ratio of the cool air to the sum of the heated volatilized components and the cool air, known as the ventilation ratio, is at least 15%. A ventilation ratio of 15% enables the heated volatilized components to be made visible by the method described above. The visibility of the heated volatilized components enables the user to identify that the volatilized components have been generated and adds to the sensory experience of the smoking experience.

In another example, the ventilation ratio is between 50% and 85% to provide additional cooling to the heated volatilized components. In some cases, the ventilation ratio may be at least 60% or 65%.

Figure 2:
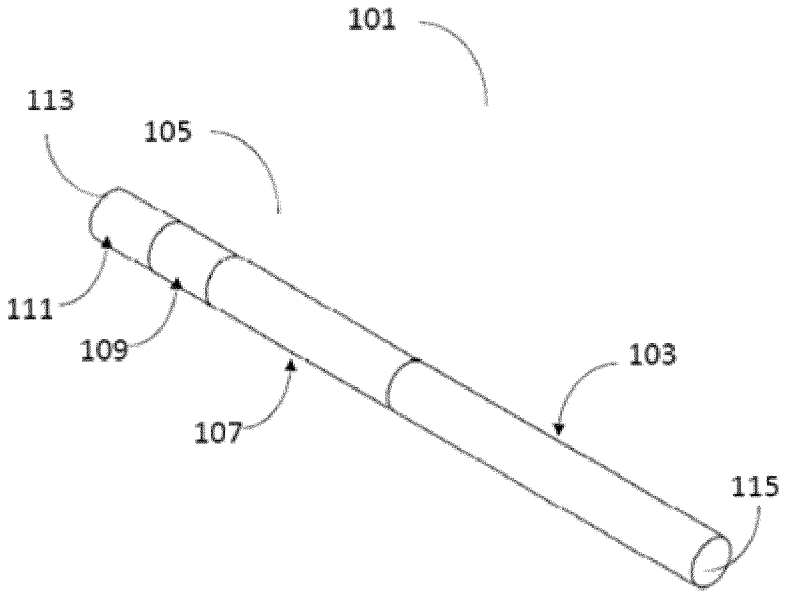
FIG. 2 shows a perspective view of the consumable of FIG. 1.

Referring to FIGS. 1 and 2, there are shown a partially cut-away section view and a perspective view of an example of article consumable 101 ("article"). The article 101 is adapted for use with a device having a power source and a heater. The article 101 of this embodiment is particularly suitable for use with the device 51 shown in FIGS. 5 to 7, described below. In use, the article 101 may be removably inserted into the device shown in FIG. 5 at an insertion point 20 of the device 51.

The article 101 of one example is in the form of a substantially cylindrical rod that includes a body of aerosol-generating material 103 and a filter assembly 105 in the form of a rod. The aerosol-generating material comprises the amorphous solid material described herein. In some embodiments, it may be included in sheet form. In some embodiments it may be included in the form of a shredded sheet. In some embodiments, the aerosol-generating material described herein may be incorporated in sheet form and in shredded form.

The filter assembly 105 includes three segments, a cooling segment 107, a filter segment 109 and a mouth end segment 111. The article 101 has a first end 113, also known as a mouth end or a proximal end and a second end 115, also known as a distal end. The body of aerosol-generating material 103 is located towards the distal end 115 of the article 101. In one example, the cooling segment 107 is located adjacent the body of aerosol-generating material 103 between the body of aerosol-generating material 103 and the filter segment 109, such that the cooling segment 107 is in an abutting relationship with the aerosol generating-material 103 and the filter segment 103. In other examples, there may be a separation between the body of aerosol-generating material 103 and the cooling segment 107 and between the body of aerosol-generating material 103 and the filter segment 109. The filter segment 109 is located in between the cooling segment 107 and the mouth end segment 111. The mouth end segment 111 is located towards the proximal end 113 of the article 101, adjacent the filter segment 109. In one example, the filter segment 109 is in an abutting relationship with the mouth end segment 111. In one embodiment, the total length of the filter assembly 105 is between 37 mm and 45 mm, more preferably, the total length of the filter assembly 105 is 41 mm.

In one example, the rod of aerosol-generating material 103 is between 34 mm and 50 mm in length, suitably between 38 mm and 46 mm in length, suitably 42 mm in length.

In one example, the total length of the article 101 is between 71 mm and 95 mm, suitably between 79 mm and 87 mm, suitably 83 mm.

An axial end of the body of aerosol-generating material 103 is visible at the distal end 115 of the article 101. However, in other embodiments, the distal end 115 of the article 101 may comprise an end member (not shown) covering the axial end of the body of aerosol-generating material 103.

The body of aerosol-generating material 103 is joined to the filter assembly 105 by annular tipping paper (not shown), which is located substantially around the circumference of the filter assembly 105 to surround the filter assembly 105 and extends partially along the length of the body of aerosol-generating material 103. In one example, the tipping paper is made of 58 GSM standard tipping base paper. In one example the tipping paper has a length of between 42 mm and 50 mm, suitably of 46 mm.

In one example, the cooling segment 107 is an annular tube and is located around and defines an air gap within the cooling segment. The air gap provides a chamber for heated volatilized components generated from the body of aerosol-generating material 103 to flow. The cooling segment 107 is hollow to provide a chamber for aerosol accumulation yet rigid enough to withstand axial compressive forces and bending moments that might arise during manufacture and whilst the article 101 is in use during insertion into the device 51. In one example, the thickness of the wall of the cooling segment 107 is approximately 0.29 mm.

The cooling segment 107 provides a physical displacement between the aerosol-generating material 103 and the filter segment 109. The physical displacement provided by the cooling segment 107 will provide a thermal gradient across the length of the cooling segment 107. In one example the cooling segment 107 is configured to provide a temperature differential of at least 40 degrees Celsius between a heated volatilized component entering a first end of the cooling segment 107 and a heated volatilized component exiting a second end of the cooling segment 107. In one example the cooling segment 107 is configured to provide a temperature differential of at least 60 degrees Celsius between a heated volatilized component entering a first end of the cooling segment 107 and a heated volatilized component exiting a second end of the cooling segment 107. This temperature differential across the length of the cooling element 107 protects the temperature sensitive filter segment 109 from the high temperatures of the aerosol-generating material 103 when it is heated by the device 51. If the physical displacement was not provided between the filter segment 109 and the body of aerosol-generating material 103 and the heating elements of the device 51, then the temperature sensitive filter segment may 109 become damaged in use, so it would not perform its required functions as effectively.

In one example the length of the cooling segment 107 is at least 15 mm. In one example, the length of the cooling segment 107 is between 20 mm and 30 mm, more particularly 23 mm to 27 mm, more particularly 25 mm to 27 mm, suitably 25 mm.

The cooling segment 107 is made of paper, which means that it is comprised of a material that does not generate compounds of concern, for example, toxic compounds when in use adjacent to the heater of the device 51. In one example, the cooling segment 107 is manufactured from a spirally wound paper tube which provides a hollow internal chamber yet maintains mechanical rigidity. Spirally wound paper tubes are able to meet the tight dimensional accuracy requirements of high-speed manufacturing processes with respect to tube length, outer diameter, roundness and straightness.

In another example, the cooling segment 107 is a recess created from stiff plug wrap or tipping paper. The stiff plug wrap or tipping paper is manufactured to have a rigidity that is sufficient to withstand the axial compressive forces and bending moments that might arise during manufacture and whilst the article 101 is in use during insertion into the device 51.

The filter segment 109 may be formed of any filter material sufficient to remove one or more volatilized compounds from heated volatilized components from the aerosol-generating material. In one example the filter segment 109 is made of a mono-acetate material, such as cellulose acetate. The filter segment 109 provides cooling and irritation-reduction from the heated volatilized components without depleting the quantity of the heated volatilized components to an unsatisfactory level for a user.

In some embodiments, a capsule (not illustrated) may be provided in filter segment 109. It may be disposed substantially centrally in the filter segment 109, both across the filter segment 109 diameter and along the filter segment 109 length. In other cases, it may be offset in one or more dimension. The capsule may in some cases, where present, contain a volatile component such as a flavor or aerosol-former material.

The density of the cellulose acetate tow material of the filter segment 109 controls the pressure drop across the filter segment 109, which in turn controls the draw resistance of the article 101. Therefore the selection of the material of the filter segment 109 is important in controlling the resistance to draw of the article 101. In addition, the filter segment performs a filtration function in the article 101.

In one example, the filter segment 109 is made of a 8Y15 grade of filter tow material, which provides a filtration effect on the heated volatilized material, whilst also reducing the size of condensed aerosol droplets which result from the heated volatilized material.

The presence of the filter segment 109 provides an insulating effect by providing further cooling to the heated volatilized components that exit the cooling segment 107. This further cooling effect reduces the contact temperature of the user's lips on the surface of the filter segment 109.

In one example, the filter segment 109 is between 6 mm to 10 mm in length, suitably 8 mm.

The mouth end segment 111 is an annular tube and is located around and defines an air gap within the mouth end segment 111. The air gap provides a chamber for heated volatilized components that flow from the filter segment 109. The mouth end segment 111 is hollow to provide a chamber for aerosol accumulation yet rigid enough to withstand axial compressive forces and bending moments that might arise during manufacture and whilst the article is in use during insertion into the device 51. In one example, the thickness of the wall of the mouth end segment 111 is approximately 0.29 mm. In one example, the length of the mouth end segment 111 is between 6 mm to 10 mm, suitably 8 mm.

The mouth end segment 111 may be manufactured from a spirally wound paper tube which provides a hollow internal chamber yet maintains critical mechanical rigidity. Spirally wound paper tubes are able to meet the tight dimensional accuracy requirements of high-speed manufacturing processes with respect to tube length, outer diameter, roundness and straightness.

The mouth end segment 111 provides the function of preventing any liquid condensate that accumulates at the exit of the filter segment 109 from coming into direct contact with a user.

It should be appreciated that, in one example, the mouth end segment 111 and the cooling segment 107 may be formed of a single tube and the filter segment 109 is located within that tube separating the mouth end segment 111 and the cooling segment 107.

Figure 3:
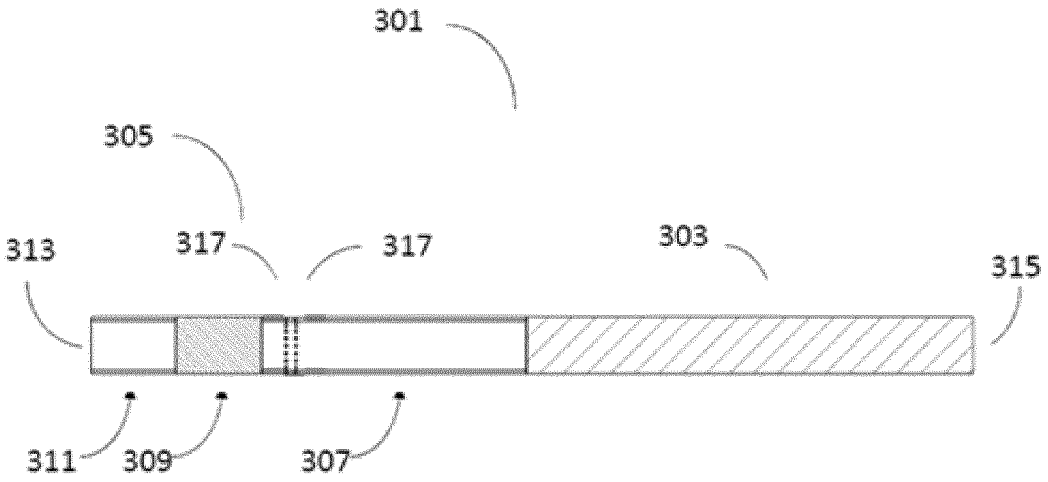
FIG. 3 shows a sectional elevation of an example of a consumable.
Figure 4:
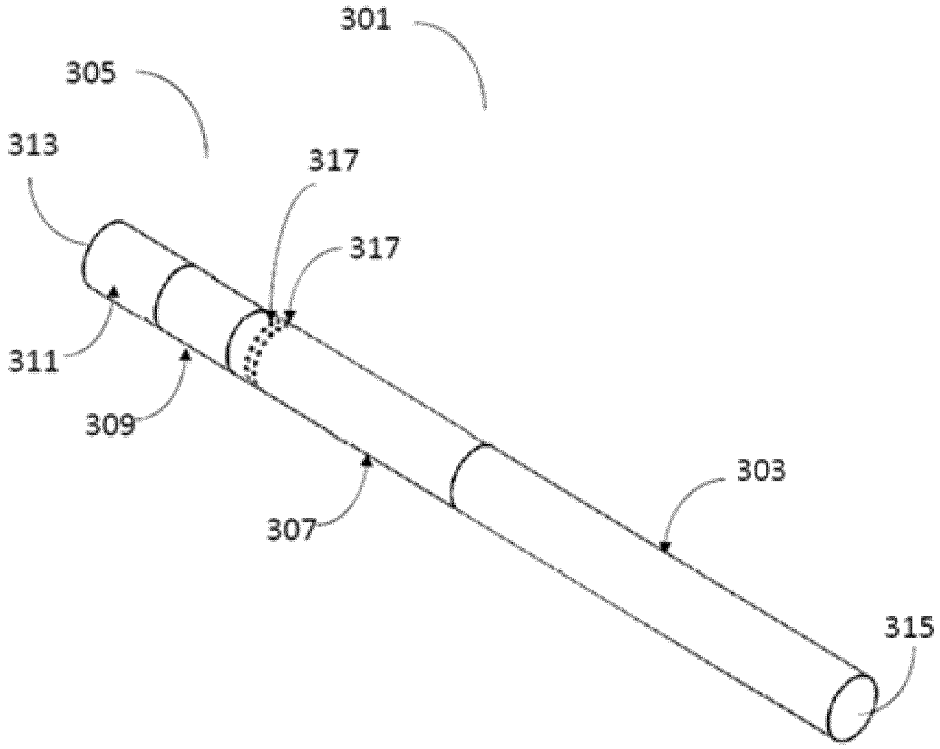
FIG. 4 shows a perspective view of the consumable of FIG. 3.

Referring to FIGS. 3 and 4, there are shown a partially cut-away section and perspective views of an example of an article 301. The reference signs shown in FIGS. 3 and 4 are equivalent to the reference signs shown in FIGS. 1 and 2, but with an increment of 200.

In the example of the article 301 shown in FIGS. 3 and 4, a ventilation region 317 is provided in the article 301 to enable air to flow into the interior of the article 301 from the exterior of the article 301. In one example the ventilation region 317 takes the form of one or more ventilation holes 317 formed through the outer layer of the article 301. The ventilation holes may be located in the cooling segment 307 to aid with the cooling of the article 301. In one example, the ventilation region 317 comprises one or more rows of holes, and preferably, each row of holes is arranged circumferentially around the article 301 in a cross-section that is substantially perpendicular to a longitudinal axis of the article 301.

In one example, there are between one to four rows of ventilation holes to provide ventilation for the article 301. Each row of ventilation holes may have between 12 to 36 ventilation holes 317. The ventilation holes 317 may, for example, be between 100 to 500 μm in diameter. In one example, an axial separation between rows of ventilation holes 317 is between 0.25 mm and 0.75 mm, suitably 0.5 mm.

In one example, the ventilation holes 317 are of uniform size. In another example, the ventilation holes 317 vary in size. The ventilation holes can be made using any suitable technique, for example, one or more of the following techniques: laser technology, mechanical perforation of the cooling segment 307 or pre-perforation of the cooling segment 307 before it is formed into the article 301. The ventilation holes 317 are positioned so as to provide effective cooling to the article 301.

In one example, the rows of ventilation holes 317 are located at least 11 mm from the proximal end 313 of the article, suitably between 17 mm and 20 mm from the proximal end 313 of the article 301. The location of the ventilation holes 317 is positioned such that user does not block the ventilation holes 317 when the article 301 is in use.

Figure 6:
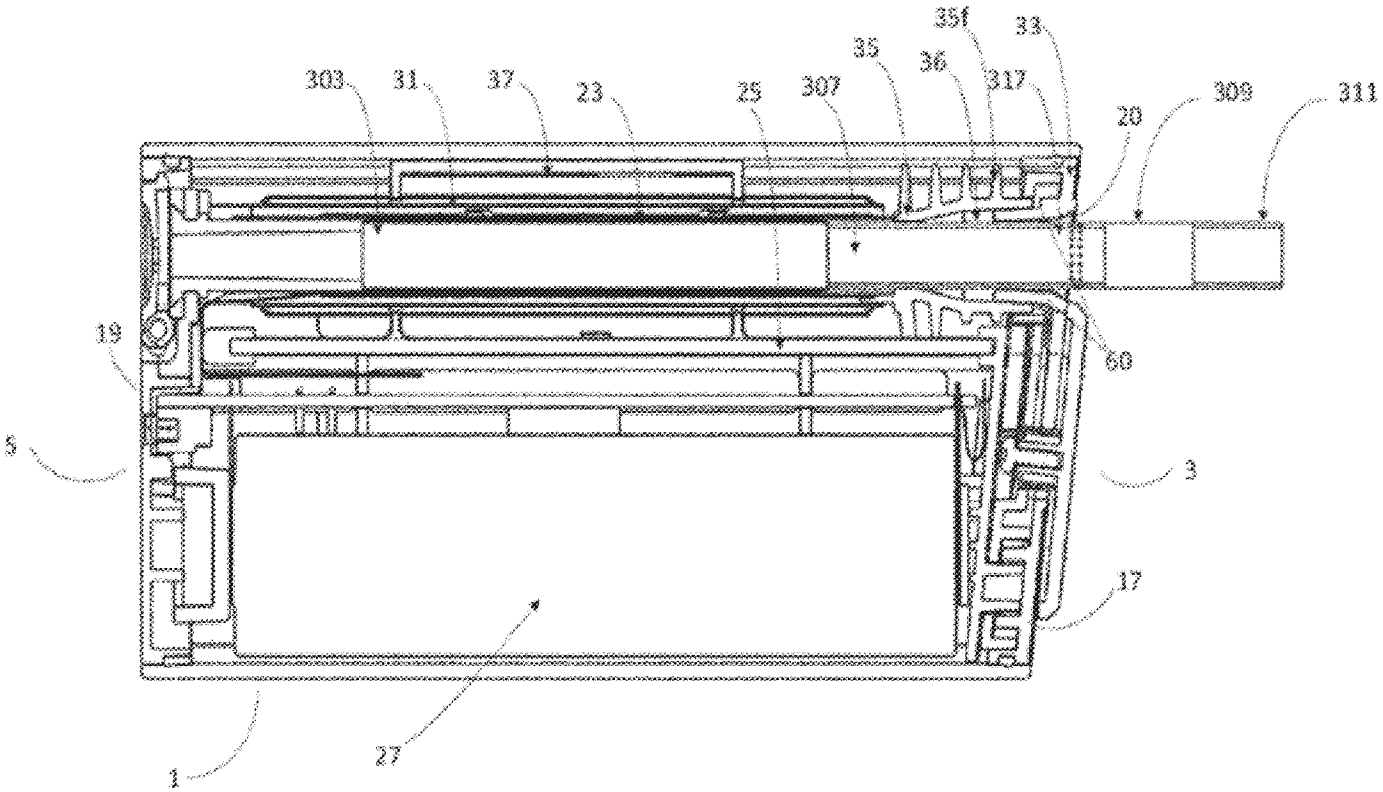
FIG. 6 shows a section view of an example of a non-combustible aerosol provision system.
Figure 7:
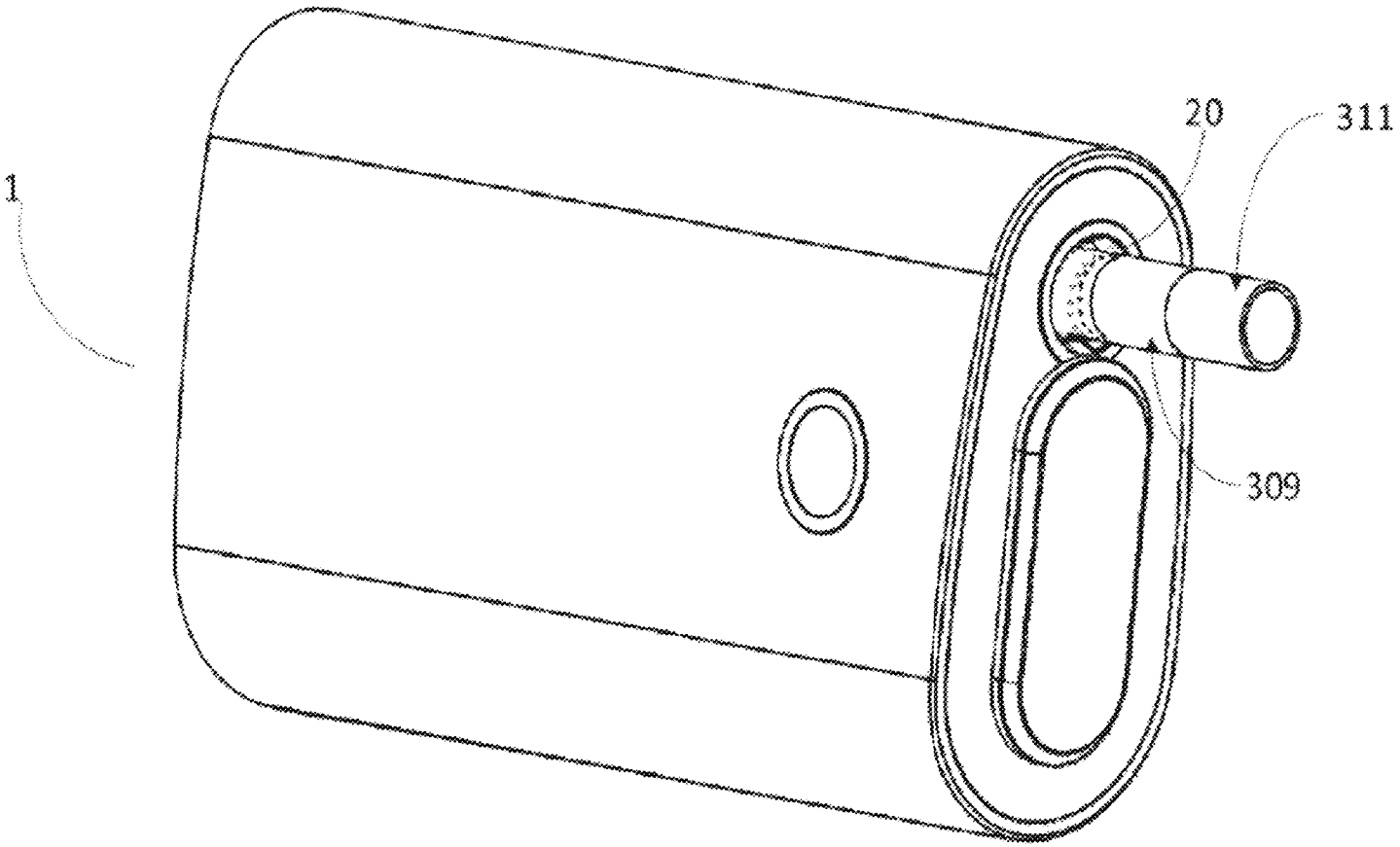
FIG. 7 shows a perspective view of an example of a non-combustible aerosol provision system.

Providing the rows of ventilation holes between 17 mm and 20 mm from the proximal end 313 of the article 301 enables the ventilation holes 317 to be located outside of the device 51, when the article 301 is fully inserted in the device 51, as can be seen in FIGS. 6 and 7. By locating the ventilation holes outside of the device, non-heated air is able to enter the article 301 through the ventilation holes from outside the device 51 to aid with the cooling of the article 301.

The length of the cooling segment 307 is such that the cooling segment 307 will be partially inserted into the device 51, when the article 301 is fully inserted into the device 51. The length of the cooling segment 307 provides a first function of providing a physical gap between the heater arrangement of the device 51 and the heat sensitive filter arrangement 309, and a second function of enabling the ventilation holes 317 to be located in the cooling segment, whilst also being located outside of the device 51, when the article 301 is fully inserted into the device 51. As can be seen from FIGS. 6 and 7, the majority of the cooling element 307 is located within the device 51. However, there is a portion of the cooling element 307 that extends out of the device 51. It is in this portion of the cooling element 307 that extends out of the device 51 in which the ventilation holes 317 are located.

Figure 5:
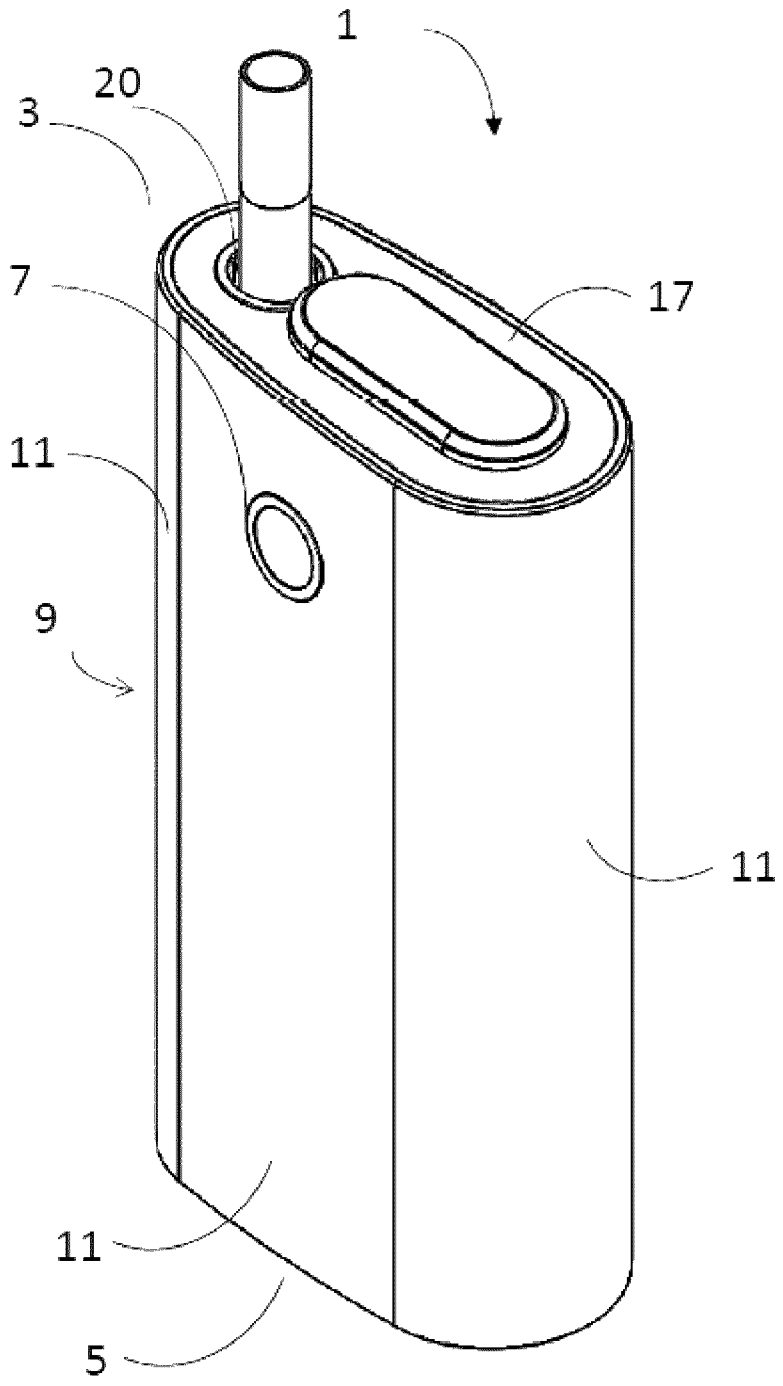
FIG. 5 shows a perspective view of an example of a non-combustible aerosol provision system.

Referring now to FIGS. 5 to 7 in more detail, there is shown an example of a device 51 arranged to heat aerosol-generating material to volatilize at least one component of said aerosol-generating material, typically to form an aerosol which can be inhaled. The device 51 is a heating device which releases compounds by heating, but not burning, the aerosol-generating material.

A first end 53 is sometimes referred to herein as the mouth or proximal end 53 of the device 51 and a second end 55 is sometimes referred to herein as the distal end 55 of the device 51. The device 51 has an on/off button 57 to allow the device 51 as a whole to be switched on and off as desired by a user.

The device 51 comprises a housing 59 for locating and protecting various internal components of the device 51. In the example shown, the housing 59 comprises a uni-body sleeve 11 that encompasses the perimeter of the device 51, capped with a top panel 17 which defines generally the 'top' of the device 51 and a bottom panel 19 which defines generally the 'bottom' of the device 51. In another example the housing comprises a front panel, a rear panel and a pair of opposite side panels in addition to the top panel 17 and the bottom panel 19.

The top panel 17 and/or the bottom panel 19 may be removably fixed to the uni-body sleeve 11, to permit easy access to the interior of the device 51, or may be "permanently" fixed to the uni-body sleeve 11, for example to deter a user from accessing the interior of the device 51. In an example, the panels 17 and 19 are made of a plastics material, including for example glass-filled nylon formed by injection molding, and the uni-body sleeve 11 is made of aluminium, though other materials and other manufacturing processes may be used.

The top panel 17 of the device 51 has an opening 20 at the mouth end 53 of the device 51 through which, in use, the article 101, 301 including the aerosol-generating material may be inserted into the device 51 and removed from the device 51 by a user.

The housing 59 has located or fixed therein a heater arrangement 23, control circuitry 25 and a power source 27. In this example, the heater arrangement 23, the control circuitry 25 and the power source 27 are laterally adjacent (that is, adjacent when viewed from an end), with the control circuitry 25 being located generally between the heater arrangement 23 and the power source 27, though other locations are possible.

The control circuitry 25 may include a controller, such as a microprocessor arrangement, configured and arranged to control the heating of the aerosol-generating material in the article 101, 301 as discussed further below.

The power source 27 may be for example a battery, which may be a rechargeable battery or a non-rechargeable battery. Examples of suitable batteries include for example a lithium-ion battery, a nickel battery (such as a nickel-cadmium battery), an alkaline battery and/or the like. The battery 27 is electrically coupled to the heater arrangement 23 to supply electrical power when required and under control of the control circuitry 25 to heat the aerosol-generating material in the article (as discussed, to volatilize the aerosol-generating material without causing the aerosol-generating material to burn).

An advantage of locating the power source 27 laterally adjacent to the heater arrangement 23 is that a physically large power source 25 may be used without causing the device 51 as a whole to be unduly lengthy. As will be understood, in general a physically large power source 25 has a higher capacity (that is, the total electrical energy that can be supplied, often measured in Amp-hours or the like) and thus the battery life for the device 51 can be longer.

In one example, the heater arrangement 23 is generally in the form of a hollow cylindrical tube, having a hollow interior heating chamber 29 into which the article 101, 301 comprising the aerosol-generating material is inserted for heating in use. Different arrangements for the heater arrangement 23 are possible. For example, the heater arrangement 23 may comprise a single heating element or may be formed of plural heating elements aligned along the longitudinal axis of the heater arrangement 23. The or each heating element may be annular or tubular, or at least part-annular or part-tubular around its circumference. In an example, the or each heating element may be a thin film heater. In another example, the or each heating element may be made of a ceramics material. Examples of suitable ceramics materials include alumina and aluminium nitride and silicon nitride ceramics, which may be laminated and sintered. Other heating arrangements are possible, including for example inductive heating, infrared heater elements, which heat by emitting infrared radiation, or resistive heating elements formed by for example a resistive electrical winding.

In one particular example, the heater arrangement 23 is supported by a stainless steel support tube and comprises a polyimide heating element. The heater arrangement 23 is dimensioned so that substantially the whole of the body of aerosol-generating material 103, 303 of the article 101, 301 is inserted into the heater arrangement 23 when the article 101, 301 is inserted into the device 51.

The or each heating element may be arranged so that selected zones of the aerosol-generating material can be independently heated, for example in turn (over time, as discussed above) or together (simultaneously) as desired.

The heater arrangement 23 in this example is surrounded along at least part of its length by a thermal insulator 31. The insulator 31 helps to reduce heat passing from the heater arrangement 23 to the exterior of the device 51. This helps to keep down the power requirements for the heater arrangement 23 as it reduces heat losses generally. The insulator 31 also helps to keep the exterior of the device 51 cool during operation of the heater arrangement 23. In one example, the insulator 31 may be a double-walled sleeve which provides a low pressure region between the two walls of the sleeve. That is, the insulator 31 may be for example a "vacuum" tube, i.e. a tube that has been at least partially evacuated so as to minimize heat transfer by conduction and/or convection. Other arrangements for the insulator 31 are possible, including using heat insulating materials, including for example a suitable foam-type material, in addition to or instead of a double-walled sleeve.

The housing 59 may further comprises various internal support structures 37 for supporting all internal components, as well as the heating arrangement 23.

The device 51 further comprises a collar 33 which extends around and projects from the opening 20 into the interior of the housing 59 and a generally tubular chamber 35 which is located between the collar 33 and one end of the vacuum sleeve 31. The chamber 35 further comprises a cooling structure **35*f*, which in this example, comprises a plurality of cooling fins 35*f* spaced apart along the outer surface of the chamber 35, and each arranged circumferentially around outer surface of the chamber 35. There is an air gap 36 between the hollow chamber 35 and the article 101, 301 when it is inserted in the device 51 over at least part of the length of the hollow chamber 35. The air gap 36 is around all of the circumference of the article 101, 301 over at least part of the cooling segment 307**.

The collar 33 comprises a plurality of ridges 60 arranged circumferentially around the periphery of the opening 20 and which project into the opening 20. The ridges 60 take up space within the opening 20 such that the open span of the opening 20 at the locations of the ridges 60 is less than the open span of the opening at the locations without the ridges 60. The ridges 60 are configured to engage with an article 101, 301 inserted into the device to assist in securing it within the device 51. Open spaces (not shown in the Figures) defined by adjacent pairs of ridges 60 and the article 101, 301 form ventilation paths around the exterior of the article 101, 301. These ventilation paths allow hot vapors that have escaped from the article 101, 301 to exit the device 51 and allow cooling air to flow into the device 51 around the article 101, 301 in the air gap 36.

In operation, the article 101, 301 is removably inserted into an insertion point of the device 51, as shown in FIGS. 5 to 7. Referring particularly to FIG. 6, in one example, the body of aerosol-generating material 103, 303, which is located towards the distal end 115, 315 of the article 101, 301, is entirely received within the heater arrangement 23 of the device 51. The proximal end 113, 313 of the article 101, 301 extends from the device 51 and acts as a mouthpiece assembly for a user.

In operation, the heater arrangement 23 will heat the article 101, 301 to volatilize at least one component of the aerosol-generating material from the body of aerosol-generating material 103, 303.

The primary flow path for the heated volatilized components from the body of aerosol-generating material 103, 303 is axially through the article 101, 301, through the chamber inside the cooling segment 107, 307, through the filter segment 109, 309, through the mouth end segment 111, 313 to the user. In one example, the temperature of the heated volatilized components that are generated from the body of aerosol-generating material is between 60° C. and 250° C., which may be above the acceptable inhalation temperature for a user. As the heated volatilized component travels through the cooling segment 107, 307, it will cool and some volatilized components will condense on the inner surface of the cooling segment 107, 307.

In the examples of the article 301 shown in FIGS. 3 and 4, cool air will be able to enter the cooling segment 307 via the ventilation holes 317 formed in the cooling segment 307. This cool air will mix with the heated volatilized components to provide additional cooling to the heated volatilized components.

Method of Manufacture

In another aspect, there is provided a method of forming an amorphous solid comprising:

about 1 to about 50 wt % constituent, derivative or extract of *cannabis;* about 10 to about 80 wt % aerosol-former material;

gelling agent, the gelling agent comprising cellulose or a derivative thereof, and a non-cellulosic gelling agent; and optionally filler, wherein the amount of gelling agent and optional filler taken together is from about 10 to about 60 wt %;

wherein the wt % values are calculated on a dry weight basis;

the method comprising:

(a) providing a slurry comprising the constituent, derivative or extract of *cannabis*, gelling agent, the gelling agent comprising cellulose or a derivative thereof, and a non-cellulosic gelling agent, aerosol-forming agent, a solvent and any optional further components of the amorphous solid;

(b) forming a layer of the slurry;

(c) optionally setting the layer of the slurry; and (d) drying the slurry to form the amorphous solid.

Another aspect of the invention provides a method of making the consumable or system as previously described. This method comprises a method of making the amorphous solid and incorporating the amorphous solid into the consumable or system. The method may comprise (a) forming a slurry comprising components of the amorphous solid or precursors thereof, (b) forming a layer of the slurry, and (c) optionally setting the slurry, (d) drying to form an amorphous solid, and (e) incorporating the resulting amorphous solid into the consumable or system.

In step (a), the constituent, derivative or extract of *cannabis* may first be dissolved in the aerosol-former material and the resulting solution then added to the other components of the slurry.

The step (b) in the above methods of forming a layer of the slurry may comprise spraying, casting or extruding the slurry, for example. In some cases, the layer is formed by electrospraying the slurry. In some cases, the layer is formed by casting the slurry.

In some cases, the steps (b) and/or (c) and/or (d) may, at least partially, occur simultaneously (for example, during electrospraying). In some cases, these steps may occur sequentially.

In some cases, a setting agent (such as a calcium source) may be added to the slurry before or during step (b). This is appropriate in instances where gelation occurs relatively slowly (e.g. with alginate gelling agent), and thus the slurry may be, e.g. cast, after the setting agent is added.

In other cases, the step (c) of optionally setting the slurry may comprise the addition of a setting agent to the slurry layer. The setting agent may be sprayed onto the slurry, for example, or may be preloaded onto the surface on which the slurry is layered.

For example, a setting agent comprising a calcium source (such as calcium chloride or calcium citrate), may be added to a slurry containing alginate and/or pectin to form a calcium-crosslinked alginate/pectin gel. In some cases where gelation occurs rapidly (such as those in which a pectin gelling agent is used), the calcium should be added after casting. Direct addition of the setting agent to gelling agent may result in a slurry too viscous to cast or spread on the carrier support sheet.

The total amount of the setting agent, such as a calcium source, may be 0.5-5 wt % (calculated on a dry weight basis). It has been found that the addition of too little setting agent may result in a weak or unstable gel matrix with less capability of flavor entrapment. It has also been found that the addition of too much setting agent results in a gel that is very tacky or very brittle and consequently has poor handleability.

Alginate salts are derivatives of alginic acid and are typically high molecular weight polymers (10-600 kDa). Alginic acid is a copolymer of β-D-mannuronic (M) and α-L-guluronic acid (G) units (blocks) linked together by (1,4)-glycosidic bonds to form a polysaccharide. On addition of calcium cations, the alginate crosslinks to form a gel. Alginate salts with a high G monomer content may more readily form a gel on addition of the calcium source. In some cases therefore, the gel-precursor may comprise an alginate salt in which at least about 40%, 45%, 50%, 55%, 60% or 70% of the monomer units in the alginate copolymer are α-L-guluronic acid (G) units.

In some cases, the slurry may be warmed prior to and during casting. This can slow gelation, improving handleability and easing the casting process. Further, warming the slurry may melt optional flavor components (e.g. menthol) easing handleability.

In some cases, menthol or other optional flavors may be added to the slurry in powder form. In some cases, menthol or other flavors may be added to the slurry in molten form (where it is warmed). In such cases, an emulsifying agent such as acacia gum may be added to disperse molten menthol in the slurry.

In some cases, the slurry may be cast onto a bandcast sheet or carrier support sheet. The carrier sheet may be loaded (e.g. sprayed or lightly coated) with a releasing agent, such as lecithin, which can aid separation of the carrier support sheet from the amorphous solid.

During step (d) the slurry may be heated to remove at least about 60 wt %, 70 wt %, 80 wt %, 85 wt % or 90 wt % of the solvent.

The aerosol-generating film may be formed by combining the constituent, derivative or extract of *cannabis*, aerosol-former material, gelling agent, a solvent and any optional further components to form a slurry and then heating the slurry to volatize at least some of the solvent to form the aerosol-generating film. The slurry may be heated to remove at least 60 wt %, 70 wt %, 80 wt %, 85 wt % or 90 wt % of the solvent.

In another aspect, there is provided a slurry comprising:

about 1 to about 50 wt % constituent, derivative or extract of *cannabis;* about 10 to about 80 wt % aerosol-former material;

gelling agent, the gelling agent comprising cellulose or a derivative thereof, and a non-cellulosic gelling agent; and optionally filler, wherein the amount of gelling agent and optional filler taken together is from about 10 to about 60 wt %;

wherein the wt % values are calculated on a dry weight basis; and a solvent.

In some embodiments the slurry solvent comprises, or is, one or more of water, ethanol, methanol, dimethyl sulfoxide, acetone, hexane, and toluene.

In particular embodiments, the slurry solvent may comprise water. In some cases, the slurry solvent may consist essentially of or consist of water.

In some cases, the slurry may comprise from about 50 wt %, 60 wt %, 70 wt %, 80 wt % or 90 wt % of solvent (WWB).

In some examples, the slurry has a viscosity of from about 1 to about 20 Pas at 46.5° C., such as from about 10 to about 20 Pas at 46.5° C., such as from about 14 to about 16 Pas at 46.5° C.

The discussion herein relating to the amorphous solid is explicitly disclosed in combination with any slurry aspect of the invention.

Composition for Oral Delivery of Constituent, Derivative or Extract of *Cannabis*

Also provided is a composition for oral delivery of a constituent, derivative or extract of *cannabis* comprising an amorphous solid, the amorphous solid comprising:

- about 1 to about 50 wt % constituent, derivative or extract of *cannabis;*
- about 10 to about 80 wt % humectant;
- gelling agent, the gelling agent comprising cellulose or a derivative thereof; and
- optionally filler, wherein the amount of gelling agent and optional filler taken together is from about 10 to about 60 wt %;

wherein the wt % values are calculated on a dry weight basis.

In some embodiments, the composition for oral delivery may be provided in the form of chews, soluble strips, lozenges, gums, snus or moist snuff.

In some embodiments, the composition for oral delivery further comprises one or more additives selected from sweeteners, taste modifiers, salts, buffering agents, colorants, oral care additives, preservatives, disintegration aids, emulsifiers, preservatives and antioxidants.

The aerosol-former material discussed above may be used as the humectant in the compositions for oral delivery. The above disclosures (for example those regarding the constituents, derivatives or extracts of *cannabis*, gelling agent, aerosol-former material [humectant], optional fillers, other optional ingredients such as additional active substances, flavors, and other functional materials), in relation to the amorphous solid for use in aerosol generation apply equally to this aspect of the invention.

For example, the humectant may comprise one or more compounds selected from glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

In some embodiments, the humectant may comprise one or more of erythritol, propylene glycol, glycerol, and triacetin. In some cases, the humectant comprises, consists essentially of or consists of glycerol, optionally in combination with propylene glycol.

Suitably, the amorphous solid may comprise from about 10 wt % to about 80 wt % of humectant (calculated on a dry weight basis), for example about 20 to 80 wt % or about 30 wt % or 40 wt % to about 80 wt %, 75 wt %, or 60 wt %.

The composition for oral delivery may comprise from about 10 to 100 wt % of the amorphous solid, or from about 20 wt %, about 30 wt %, about 40 wt %, about 50 wt %, to about 60 wt %, about 70 wt %, about 80 wt % or about 90 wt % of the amorphous solid. For example, in some embodiments, the composition for oral delivery may comprise from about 10-60 wt %, such as about 15-50 wt %, of the amorphous solid. These wt % values are calculated on a wet weight basis (WWB), i.e. including any water or other solvent present in the amorphous solid.

Example Embodiments

1. An amorphous solid or slurry as defined in the Summary of the Disclosure comprising about 1-50 wt % constituent(s), derivative(s) or extract(s) of *cannabis*.
2. The amorphous solid or slurry of Embodiment 1 comprising about 1-12 wt % constituent(s), derivative (s) or extract(s) of *cannabis*.
3. The amorphous solid or slurry of Embodiment 2 comprising about 1-10 wt % constituent(s), derivative (s) or extract(s) of *cannabis*.
4. The amorphous solid or slurry of Embodiment 3 comprising about 1-7 wt % constituent(s), derivative(s) or extract(s) of *cannabis*.
5. The amorphous solid or slurry of Embodiment 1 comprising about 2-12 wt % constituent(s), derivative (s) or extract(s) of *cannabis*.
6. The amorphous solid or slurry of Embodiment 5 comprising about 2-10 wt % constituent(s), derivative (s) or extract(s) of *cannabis*.
7. The amorphous solid or slurry of Embodiment 6 comprising about 2-8 wt % constituent(s), derivative(s) or extract(s) of *cannabis*.
8. The amorphous solid or slurry of Embodiment 1 comprising about 15-50 wt % constituent(s), derivative (s) or extract(s) of *cannabis*.
9. The amorphous solid or slurry of Embodiment 8 comprising about 20-40 wt % constituent(s), derivative (s) or extract(s) of *cannabis*.
10. The amorphous solid or slurry of Embodiment 8 comprising about 25-45 wt % constituent(s), derivative (s) or extract(s) of *cannabis*.
11. The amorphous solid or slurry of Embodiment 10 comprising about 25-40 wt % constituent(s), derivative (s) or extract(s) of *cannabis*.
12. The amorphous solid or slurry of Embodiment 10 comprising about 30-45 wt % constituent(s), derivative (s) or extract(s) of *cannabis*.
13. The amorphous solid or slurry of Embodiment 12 comprising about 30-40 wt % constituent(s), derivative (s) or extract(s) of *cannabis*.
14. The amorphous solid or slurry of Embodiment 12 comprising about 35-45 wt % constituent(s), derivative (s) or extract(s) of *cannabis*.
15. The amorphous solid or slurry of Embodiment 14 comprising about 35-40 wt % constituent(s), derivative (s) or extract(s) of *cannabis*.
16. The amorphous solid or slurry of any of any preceding Embodiment wherein the constituent(s), derivative(s) or extract(s) of *cannabis* comprises, or is, one or more compounds selected from: cannabinoids, terpenes, alkaloids, and flavonoids.
17. The amorphous solid or slurry of any of preceding Embodiment wherein the constituent(s), derivative(s) or extract(s) of *cannabis* comprises, or is, one or more compounds selected from: cannabinoids or terpenes.
18. The amorphous solid or slurry of any preceding Embodiment wherein the constituent(s), derivative(s) or extract(s) of *cannabis* comprises, or is, one or more cannabinoids.
19. The amorphous solid or slurry of any of Embodiments 16-18, wherein the terpenes are triterpenes.

20. The amorphous solid or slurry of any of Embodiments 16-19, wherein the cannabinoids are phytocannabinoids.
21. The amorphous solid or slurry of any of Embodiments 16-20 wherein the cannabinoids are selected from cannabigerol (CBG), cannabichromene (CBC), cannabidiol (CBD), tetrahydrocannabinol (THC), cannabinol (CBN), cannabinodiol (CBDL), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabinerolic acid, cannabidiolic acid (CBDA), cannabinol propyl variant (CBNV), cannabitriol (CBO), tetrahydrocannabmolic acid (THCA), and/or tetrahydrocannabivarinic acid (THCV A).
22. The amorphous solid or slurry of Embodiment 21 wherein the cannabinoids are selected from cannabidiol (CBD) and/or THC.
23. The amorphous solid or slurry of Embodiment 22, wherein the cannabinoid is CBD.
24. The amorphous solid or slurry of Embodiment 22, wherein the cannabinoid is THC.
25. The amorphous solid or slurry of any preceding Embodiment, comprising about 10-50 wt % gelling agent.
26. The amorphous solid or slurry of Embodiment 25 comprising about 10-45 wt % gelling agent.
27. The amorphous solid or slurry of Embodiment 26, comprising about 10-40 wt % gelling agent.
28. The amorphous solid or slurry of Embodiment 27 comprising about 10-35 wt % gelling agent.
29. The amorphous solid or slurry of Embodiment 28 comprising about 10-30 wt % gelling agent.
30. The amorphous solid or slurry of any of Embodiments 1-24, comprising about 15-65 wt % gelling agent.
31. The amorphous solid or slurry of any of Embodiments 1-24, comprising about 15-60 wt % gelling agent.
32. The amorphous solid or slurry of Embodiment 31, comprising about 15-50 wt % gelling agent.
33. The amorphous solid or slurry of Embodiment 32, comprising about 15-45 wt % gelling agent.
34. The amorphous solid or slurry of Embodiment 33, comprising about 15-40 wt % gelling agent.
35. The amorphous solid or slurry of Embodiment 34, comprising about 15-35 wt % gelling agent.
36. The amorphous solid or slurry of Embodiments 35, comprising about 15-30 wt % gelling agent.
37. The amorphous solid or slurry of any of Embodiments 1-24, comprising about 20-60 wt % gelling agent.
38. The amorphous solid or slurry of Embodiment 37, comprising about 20-50 wt % gelling agent.
39. The amorphous solid or slurry of Embodiment 38, comprising about 20-45 wt % gelling agent.
40. The amorphous solid or slurry of Embodiment 39, comprising about 20-40 wt % gelling agent.
41. The amorphous solid or slurry of Embodiment 40, comprising about 20-35 wt % gelling agent.
42. The amorphous solid or slurry of Embodiment 41, comprising about 20-30 wt % gelling agent.
43. The amorphous solid or slurry of any preceding Embodiment comprising about 1-50 wt % filler.
44. The amorphous solid or slurry of Embodiment 43, comprising about 5-40 wt % filler.
45. The amorphous solid or slurry of Embodiment 44, comprising about 10-20 wt % filler.
46. The amorphous solid or slurry of any one of Embodiments 1 to 42, comprising less than 20 wt % filler.
47. The amorphous solid or slurry of any one of Embodiments 1 to 42, comprising less than 10 wt % filler.
48. The amorphous solid or slurry of any one of Embodiments 1 to 42, comprising less than 5 wt % of a filler.
49. The amorphous solid or slurry of any one of Embodiments 1 to 42, comprising no filler.
50. The amorphous solid or slurry of any preceding Embodiment, comprising about 10-75 wt % aerosol-former material/humectant.
51. The amorphous solid or slurry of Embodiment 50, comprising about 10-60 wt % aerosol-former material/humectant.
52. The amorphous solid or slurry of Embodiment 51, comprising about 10-50 wt % aerosol-former material/humectant.
53. The amorphous solid or slurry of any of Embodiments 1-49, comprising about 20-80 wt % aerosol-former material/humectant.
54. The amorphous solid or slurry of Embodiment 53, comprising about 20-75 wt % aerosol-former material/humectant.
55. The amorphous solid or slurry of Embodiment 54, comprising about 20-60 wt % aerosol-former material/humectant.
56. The amorphous solid or slurry of Embodiment 55, comprising about 20-50 wt % aerosol-former material/humectant.
57. The amorphous solid or slurry of any of Embodiments 1-49, comprising about 30-80 wt % aerosol-former material/humectant.
58. The amorphous solid or slurry of Embodiment 57, comprising about 30-75 wt % aerosol-former material/humectant.
59. The amorphous solid or slurry of Embodiment 58, comprising about 30-60 wt % aerosol-former material/humectant.
60. The amorphous solid or slurry of Embodiment 59, comprising about 30-50 wt % aerosol-former material/humectant.
61. The amorphous solid or slurry of any of Embodiments 1-49, comprising about 40-80 wt % aerosol-former material/humectant.
62. The amorphous solid or slurry of Embodiment 61, comprising about 40-75 wt % aerosol-former material/humectant.
63. The amorphous solid or slurry of Embodiment 62, comprising about 40-60 wt % aerosol-former material/humectant.
64. The amorphous solid or slurry of Embodiment 63, comprising about 40-50 wt % aerosol-former material/humectant.
65. The amorphous solid or slurry of any of Embodiments 1-49, comprising about 50-80 wt % aerosol-former material/humectant.
66. The amorphous solid or slurry of Embodiment 65, comprising about 60 to 80 wt % aerosol-former material/humectant.
67. The amorphous solid or slurry of Embodiment 66, comprising about 70 to 80 wt % aerosol-former material/humectant.
68. The amorphous solid or slurry of any of Embodiments 1-49, comprising about 30-40 wt % aerosol-former material/humectant.
69. The amorphous solid or slurry of any preceding Embodiment, wherein the aerosol-former material/humectant comprises (or is) one or more of glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

70 The amorphous solid or slurry of Embodiment 69, wherein the aerosol-former material/humectant comprises (or is) one or more of erythritol, propylene glycol, glycerol, and triacetin.

71. The amorphous solid or slurry of Embodiment 69 or 70, wherein the aerosol-former material/humectant comprises (or is) glycerol or a combination or glycerol and propylene glycol.

72. The amorphous solid or slurry of Embodiment 71, wherein the aerosol-former material comprises a mixture of glycerol and propylene glycol in a weight ratio of glycerol to propylene glycol of about 3:1 to 1:3.

73. The amorphous solid or slurry of Embodiment 72, wherein the aerosol-former material comprises a mixture of glycerol and propylene glycol in a weight ratio of glycerol to propylene glycol of about 2:1 to 1:2.

74. The amorphous solid or slurry of Embodiment 73, wherein the aerosol-former material comprises a mixture of glycerol and propylene glycol in a weight ratio of glycerol to propylene glycol of about 1.5:1 to 1:1.5.

75. The amorphous solid or slurry of Embodiment 74, wherein the aerosol-former material comprises a mixture of glycerol and propylene glycol in a weight ratio of glycerol to propylene glycol of about 55:45 to 45:55.

76. The amorphous solid or slurry of Embodiment 75, wherein the aerosol-former material comprises a mixture of glycerol and propylene glycol in a weight ratio of glycerol to propylene glycol of about 45:55.

77. The amorphous solid or slurry of any of preceding Embodiment, wherein the cellulose or derivative thereof comprises (or is) one or more compound selected from hydroxymethyl cellulose, hydroxyethyl cellulose, hydroxypropyl cellulose, carboxymethyl cellulose (CMC), hydroxypropyl methylcellulose (HPMC), methyl cellulose, ethyl cellulose, cellulose acetate (CA), cellulose acetate butyrate (CAB), and cellulose acetate propionate (CAP).

78. The amorphous solid or slurry of any preceding Embodiment, wherein the cellulose or derivative thereof is selected from hydroxyethyl cellulose, hydroxypropyl cellulose and/or carboxymethyl cellulose.

79. The amorphous solid or slurry of any of any preceding Embodiment, wherein the cellulose or derivative thereof comprises carboxymethyl cellulose.

80. The amorphous solid or slurry of Embodiment 79 wherein the cellulose or derivative thereof consists of carboxymethyl cellulose.

81. The amorphous solid or slurry of any preceding Embodiment wherein the non-cellulosic gelling agent is selected from alginate, pectin, starch or a derivative thereof, pullulan, carrageenan, agar and agarose; gelatin; gums, such as xanthan gum, guar gum and acacia gum; silica or silicone compounds, such as PDMS and sodium silicate; clays, such as kaolin; and polyvinyl alcohol.

82. The amorphous solid or slurry of Embodiment 81 wherein the non-cellulosic gelling agent is selected from alginate, pectin, starch or a derivative thereof, or guar gum.

83. The amorphous solid or slurry of Embodiment 82 wherein the non-cellulosic gelling agent is alginate.

84. The amorphous solid or slurry of any preceding Embodiment, wherein the gelling agent comprises (or consists of) carboxymethyl cellulose and alginate.

85. The amorphous solid or slurry of any preceding Embodiment, wherein the weight ratio of cellulose or derivative thereof to non-cellulosic gelling agent is from 2:3 to 3:2.

86. The amorphous solid or slurry of Embodiment 85, wherein the weight ratio of cellulose or derivative thereof to non-cellulosic gelling agent is 1:1 to 3:2.

87. The amorphous solid or slurry of any of Embodiments 1-84, wherein the weight ratio of cellulose or derivative thereof to non-cellulosic gelling agent is >1:1.

88. The amorphous solid or slurry of any preceding Embodiment, comprising a crosslinking agent.

89. The amorphous solid or slurry of Embodiment 88, wherein the crosslinking agent comprises calcium ions.

90. The amorphous solid or slurry of Embodiment 88 or 89, comprising about 0.5-5 wt % crosslinking agent.

91. The amorphous solid or slurry of any of Embodiments 81-84 wherein the alginate is sodium alginate.

92. The amorphous solid or slurry of any preceding Embodiment, wherein the gelling agent is not crosslinked.

93. The amorphous solid or slurry of any of Embodiments 43 to 48, wherein the filler is selected from inorganic filler materials, wood pulp; tobacco pulp; hemp fiber; starch and starch derivatives, such as maltodextrin; chitosan; cellulose and cellulose derivatives.

94. The amorphous solid or slurry of Embodiment 93, wherein the filler is wood pulp.

95. The amorphous solid or slurry of any preceding Embodiment, wherein the amorphous solid or slurry comprises no calcium carbonate such as chalk.

96. The amorphous solid or slurry of any preceding Embodiment, wherein the amorphous solid or slurry does not comprise tobacco fibers.

97. The amorphous solid of any preceding Embodiment, wherein the amorphous solid consists of, or consists essentially of, gelling agent, solvent such as water, aerosol-former material, constituents, derivatives or extracts of *cannabis*, and optionally a flavor and/or optionally an additional active substance and/or optionally a filler.

98. The amorphous solid of any preceding Embodiment, wherein the amorphous solid consists of, or consists essentially of, gelling agent, solvent such as water, aerosol-former material, and constituents, derivatives or extracts of *cannabis*.

99. An aerosol-generating material comprising an amorphous solid according to any preceding Embodiment.

100. The aerosol-generating material of Embodiment 99, wherein the aerosol-generating material does not comprise tobacco fibers.

101. The aerosol-generating material of any of Embodiments 99-100, comprising from about 50-100 wt % (WWB) of the amorphous solid.

102. The aerosol-generating material of Embodiment 101, comprising from about 50-95 wt % (WWB) of the amorphous solid.

103. The aerosol-generating material of Embodiment 102, comprising from about 50-90 wt % (WWB) of the amorphous solid.
104. The aerosol-generating material of any of Embodiments 99-100, comprising from about 60-100 wt % (WWB) of the amorphous solid.
105. The aerosol-generating material of Embodiment 104, comprising from about 60-95 wt % (WWB) of the amorphous solid.
106. The aerosol-generating material of Embodiment 105, comprising from about 60-90 wt % (WWB) of the amorphous solid.
107. The aerosol-generating material of any of Embodiments 99-100, comprising from about 70-100 wt % (WWB) of the amorphous solid.
108. The aerosol-generating material of Embodiment 107, comprising from about 70-95 wt % (WWB) of the amorphous solid.
109. The aerosol-generating material of Embodiment 108, comprising from about 70-90 wt % (WWB) of the amorphous solid.
110. The aerosol-generating material of any of Embodiments 99-100, consisting of, or consisting essentially of the amorphous solid.
111. A consumable for use in a non-combustible aerosol provision device, the consumable comprising the aerosol-generating material of any of Embodiments 99-110.
112. A non-combustible aerosol provision system comprising the consumable of Embodiment 111 and a non-combustible aerosol provision device.
113. The consumable for use in a non-combustible aerosol provision device of Embodiment 111, or the non-combustible aerosol provision system of Embodiment 112, wherein the non-combustible aerosol provision device is a heat-not-burn device.
114. The consumable for use in a non-combustible aerosol provision device of Embodiment 111, or the non-combustible aerosol provision system of Embodiment 112, wherein the non-combustible aerosol provision device is an electronic tobacco hybrid device.
115. A method of forming an amorphous solid as defined in any of Embodiments 1-98, the method comprising
(a) providing a slurry comprising the constituents, derivatives or extracts of *cannabis*, gelling agent the gelling agent comprising cellulose or a derivative thereof, and a non-cellulosic gelling agent, aerosol-forming agent, a solvent and any optional further components of the amorphous solid;
(b) forming a layer of the slurry;
(c) optionally setting the layer of the slurry; and
(d) drying the slurry to form the amorphous solid.
116. The method of Embodiment 115 or the slurry of any of Embodiments 1-96 wherein the solvent comprises water.
117. The method of Embodiment 115 or the slurry of any of Embodiments 1-96 wherein the solvent consists essentially of, or consists of, water.
118. The method of Embodiments 115-117 or the slurry of any of Embodiments 1-96, 116 or 117 wherein the slurry comprises from about 50 wt %, 60 wt %, 70 wt %, 80 wt % or 90 wt % of solvent (WWB).

The amorphous solid as used in the composition of the fifth aspect as defined in the Summary of the Disclosure (i.e. as used in the composition for oral delivery) may be an amorphous solid as defined in any of the preceding Embodiments.

Definitions

The aerosol-generating material described herein comprises an "amorphous solid", which may alternatively be referred to as a "monolithic solid" (i.e. non-fibrous), or as a "dried gel". The amorphous solid is a solid material that may retain some fluid, such as liquid, within it.

As used herein, the term "tobacco material" refers to any material comprising tobacco or derivatives therefore. The term "tobacco material" may include one or more of tobacco, tobacco derivatives, expanded tobacco, reconstituted tobacco or tobacco substitutes. The tobacco material may comprise one or more of ground tobacco, tobacco fiber, cut tobacco, extruded tobacco, tobacco stem, reconstituted tobacco and/or tobacco extract.

The tobacco used to produce tobacco material may be any suitable tobacco, such as single grades or blends, cut rag or whole leaf, including Virginia and/or Burley and/or Oriental. It may also be tobacco particle 'fines' or dust, expanded tobacco, stems, expanded stems, and other processed stem materials, such as cut rolled stems. The tobacco material may be a ground tobacco or a reconstituted tobacco material. The reconstituted tobacco material may comprise tobacco fibers, and may be formed by casting, a Fourdrinier-based paper making-type approach with back addition of tobacco extract, or by extrusion.

All percentages by weight described herein (denoted wt %) are calculated on a dry weight basis (DWB), unless explicitly stated otherwise. All weight ratios are also calculated on a dry weight basis. A weight quoted on a dry weight basis refers to the whole of the extract or slurry or material, other than the water or other solvent, and may include components which by themselves are liquid at room temperature and pressure, such as glycerol. Conversely, a weight percentage quoted on a wet weight basis (WWB) refers to all components, including water or other solvent.

For the avoidance of doubt, where in this specification the term "comprises" is used in defining the invention or features of the invention, embodiments are also disclosed in which the invention or feature can be defined using the terms "consists essentially of" or "consists of" in place of "comprises". Reference to a material "comprising" certain features means that those features are included in, contained in, or held within the material.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc, other than those specifically described herein. In addition, this disclosure may include other inventions not presently claimed, but which may be claimed in future.

The invention claimed is:

1. An amorphous solid for use in aerosol generation, the amorphous solid comprising:

about 1 to about 50 wt % constituent, derivative or extract of *cannabis*; about 10 to about 80 wt % aerosol-former material;

about 15 to about 60 wt % gelling agent, the gelling agent comprising cellulose or a derivative thereof, and a non-cellulosic gelling agent; and optionally filler, wherein the amount of gelling agent and optional filler taken together is from about 15 to about 60 wt %;

wherein the wt % values are calculated on a dry weight basis.

2. The amorphous solid of claim 1 comprising about 1 to about 12 wt % constituent, derivative or extract of *cannabis*.

3. The amorphous solid of claim 1 comprising about 15 to about 50 wt % constituent, derivative or extract of *cannabis*.

4. The amorphous solid of claim 1 comprising about 15 to about 40 wt % gelling agent.

5. The amorphous solid of claim 1, wherein the gelling agent comprises carboxymethyl cellulose (CMC) and a non-cellulosic gelling agent.

6. The amorphous of claim 1, wherein the gelling agent comprises carboxymethyl cellulose (CMC) and alginate.

7. The amorphous solid of claim 1, wherein the weight ratio of cellulosic gelling agent to non-cellulosic gelling agent is from about 1:4 to about 4:1.

8. The amorphous solid of claim 1, wherein the gelling agent is not crosslinked.

9. The amorphous solid of claim 1, wherein the constituent, derivative or extract of *cannabis* is a cannabinoid.

10. The amorphous solid of claim 9, wherein the cannabinoid is selected from cannabigerol (CBG), cannabichromene (CBC), cannabidiol (CBD), tetrahydrocannabinol (THC), cannabinol (CBN), cannabinodiol (CBDL), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabinerolic acid, cannabidiolic acid (CBDA), cannabinol propyl variant (CBNV), cannabitriol (CBO), tetrahydrocannabmolic acid (THCA), and tetrahydrocannabivarinic acid (THCV A).

11. An aerosol-generating material comprising the amorphous solid of claim 1.

12. A consumable for use in a non-combustible aerosol provision device, the consumable comprising the aerosol-generating material of claim 11.

13. A non-combustible aerosol provision system comprising the consumable of claim 12 and a non-combustible aerosol provision device.

14. The amorphous solid of claim 1, comprising about 20 to about 60 wt % gelling agent.

15. The amorphous solid of claim 1, comprising less than 20 wt % filler.

16. The amorphous solid of claim 1, wherein cellulosic gelling agent to non-cellulosic gelling agent is greater than 1:1.

17. A method of forming the amorphous solid of claim 1, the method comprising:

(a) providing a slurry comprising the constituent, derivative or extract of *cannabis*, the gelling agent, the gelling agent comprising cellulose or a derivative thereof, and a non-cellulosic gelling agent, the aerosol-former material or the humectant, a solvent and any optional further components of the amorphous solid;

(b) forming a layer of the slurry;

(c) optionally setting the layer of the slurry; and (d) drying the slurry to form the amorphous solid.

18. A composition for oral delivery of a constituent, derivative or extract of *cannabis*, the composition comprising an amorphous solid, the amorphous solid comprising:

about 1 to about 50 wt % constituent, derivative or extract of *cannabis*; about 10 to about 80 wt % humectant;

about 15 to about 60 wt % gelling agent, the gelling agent comprising cellulose or a derivative thereof, and a non-cellulosic gelling agent; and optionally filler, wherein the amount of gelling agent and optional filler taken together is from about 15 to about 60 wt %;

wherein the wt % values are calculated on a dry weight basis.

19. The composition for oral delivery of claim 18, wherein the constituent, derivative or extract of *cannabis* is a cannabinoid.

20. A slurry comprising:

about 1 to about 50 wt % constituent, derivative or extract of *cannabis;* about 10 to about 80 wt % aerosol-former material or humectant;

about 15 to about 60 wt % gelling agent, the gelling agent comprising cellulose or a derivative thereof, and a non-cellulosic gelling agent; and optionally filler, wherein the amount of gelling agent and optional filler taken together is from about 15 to about 60 wt %;

wherein the wt % values are calculated on a dry weight basis; and a solvent.

* * * * *